US010495423B2

(12) United States Patent
Burks

(10) Patent No.: US 10,495,423 B2
(45) Date of Patent: Dec. 3, 2019

(54) PORTABLE SHOOTING TARGET

(71) Applicant: Neely Marie Burks, Nashville, TN (US)

(72) Inventor: Neely Marie Burks, Nashville, TN (US)

( * ) Notice: Subject to any disclaimer, the term of this patent is extended or adjusted under 35 U.S.C. 154(b) by 0 days.

(21) Appl. No.: 15/423,455

(22) Filed: Feb. 2, 2017

(65) Prior Publication Data

US 2017/0284774 A1 Oct. 5, 2017

Related U.S. Application Data

(63) Continuation-in-part of application No. 14/205,490, filed on Mar. 12, 2014, now abandoned.

(60) Provisional application No. 61/783,079, filed on Mar. 14, 2013.

(51) Int. Cl.
*F41J 1/10* (2006.01)
*F41J 7/00* (2006.01)
*F41J 3/00* (2006.01)

(52) U.S. Cl.
CPC . *F41J 1/10* (2013.01); *F41J 7/00* (2013.01); *F41J 3/0004* (2013.01)

(58) Field of Classification Search
CPC ..... F41J 1/00; F41J 1/10; F41J 3/0004; A47F 5/116; A47B 43/02
USPC ..... 273/407–408; 206/748, 766; 229/120.09, 117.03, 117.04, 120.02, 229/120.04, 120.08; 211/149, 188
See application file for complete search history.

(56) References Cited

U.S. PATENT DOCUMENTS 1,486,695 A * 3/1924 Singer ..... B65D 5/5253 206/747
1,559,171 A * 10/1925 Knowles ..... A63F 9/0204 273/392
3,440,747 A * 4/1969 Oliver ..... G09F 1/04 206/831
5,664,782 A * 9/1997 Lacks ..... F41J 3/0028 273/317.5
6,105,796 A * 8/2000 Buchanan ..... A47F 9/04 186/59
6,491,164 B1 * 12/2002 Virvo ..... B65D 5/422 206/459.5
6,581,895 B1 * 6/2003 Pleasant ..... A47F 5/112 248/166

(Continued)

OTHER PUBLICATIONS

River Bend Gun Club, Inc. Range Rules, Section 2.3, p. 6, revised Sep. 2006.*

(Continued)

*Primary Examiner* — Laura Davison
(74) *Attorney, Agent, or Firm* — Wayne Edward Ramage; Baker Donelson

(57) ABSTRACT

A collapsible, portable target shooting apparatus that is easily transported and constructed in the field, backyard, or other location for shooters to use for training and recreation. When collapsed, the apparatus lies generally flat. When expanded and assembled, portions of the apparatus comprise graphics for target shooting. A shelving system supports a variety of targets, including, but not limited to, three-dimensional targets such as fruit, cans, bottles, or any similar item. The apparatus may be made of cardboard, stiff paper, plastic, Kevlar, wood, metal, Styrofoam, or similar materials, or combinations thereof.

9 Claims, 34 Drawing Sheets

(56) References Cited

U.S. PATENT DOCUMENTS

2003/0168502 A1* 9/2003 Kisch ..... B65D 5/323
229/120.34

OTHER PUBLICATIONS

The Firearm Blog, "Pizza Box Targets", posted Nov. 20, 2012, http://www.thefirearmblog.com/blog/2012/11/20/pizza-box-targets/. *

* cited by examiner

Step 2: Box Reinforcement

Step 1: Flat and Unassembled, Unfolding

Step 4: Shelf Unit

Step 3: Staked (rear view)

PORTABLE SHOOTING TARGET

This application is a continuation-in-part of U.S. application Ser. No. 14/205,490, filed Mar. 12, 2014, which claims benefit of and priority to U.S. Provisional Application No. 61/783,079, filed Mar. 14, 2013, by Neely Burks, and is entitled to that filing date for priority. The specifications, figures and complete disclosures of U.S. Provisional Application No. 61/783,079 and application Ser. No. 14/205,490 are incorporated herein by specific reference for all purposes.

FIELD OF INVENTION

This invention relates to a portable shooting target that can be easily transported and constructed in the field. More particularly, this invention relates to a portable shooting target with a shelving system to support a variety of three-dimensional targets.

SUMMARY OF INVENTION

In various exemplary embodiments, the present system comprises a portable target shooting apparatus that is easily transported and constructed in the field, backyard, or other location for shooters to use for training and recreation. Portions of the apparatus comprise graphics for target shooting. In one embodiment, the invention further comprises a shelving system to support a variety of targets, including, but not limited to, three-dimensional targets such as fruit, cans, bottles, clay discs, or any similar item. The apparatus may be made of cardboard, stiff paper, plastic, Kevlar, wood, metal, Styrofoam, or similar materials, or combinations thereof.

In collapsed form the apparatus is a relatively flat, lightweight package, easily carried by a single individual. It may be shrink wrapped, secured by packaging straps, or otherwise fastened so as not to prematurely open. The apparatus may be self-merchandised in its collapsed state or in a partially assembled state, and thus can easily be displayed on a store shelf, gondola, or display apparatus.

The user transports the apparatus in collapsed form to the site, and begins assembly or construction. In one embodiment, assembly or construction comprises unfolding the side panels (or wings), and unfolding the reinforced support box (which forms the base of the apparatus). A reinforcement component is contained in the box itself which folds into an X-shape and is inserted into the support box to reinforce it. In alternative embodiments, a reinforcement component is not provided. Tabs, which may or may not have pre-cut slots or holes, extend from the bottom of the side panels and the support box (and may extend from front, back, or sides), and stakes can be inserted through one or more of said tabs to secure the apparatus to the ground. Where no holes are provided, the stakes are driven through the tabs directly. Alternatively, the apparatus may be weighted with stones, bricks, sand, or the like placed on the tabs or in the interior of the support box.

The support box generally comprises a front face, a top, a back face, and a bottom, contiguously attached along their respective edges, which fold and allow the box to collapse. In this embodiment, the side panels are foldingly attached to the right and left edges of the front face. The right face and left face of the box (when assembled) are contiguously attached along one edge to the right and left edges of the back face. The right and left faces each comprise a folding insert along the edge opposite the edge attached to the back face. Flaps extend from the ends of the top face and bottom face, and during assembly, these are folded inward, the corresponding right or left face is folded over the flaps, and the folding insert is inserted into the space behind the front face to form the side of the box.

An optional shelf unit may be unfolded, and tabs at the bottom of the side supports inserted into matching tabs, holes or slots in the top of the support box so that the shelf is secured on top of the support box. In one embodiment, shelf inserts may be used with the shelving unit. Three-dimensional targets or objects (e.g., cans, fruit, clay discs, or the like) may be placed thereon. In several embodiments, one or more hooks or holes are provided to allow targets (such as cans, and the like) to be suspended by hanging toggles, string or wire. The top of a shelf also may comprise one or more holes or slots to support clay discs, targets, or similar objects.

A variety of shooting target graphics are displayed on the front of the support box and the side panels, as shown. Graphics may be pre-printed on the apparatus. Alternatively, adhesive graphics or the like may be placed (or re-placed) on the apparatus. In one embodiment, replaceable graphics on a heavy card stock or similar material is slid or inserted into place on the apparatus and fastened in place.

By offering a variety of components for target shooting, the user is able to shoot multiple rounds of ammunition at the target apparatus without pausing for target resetting or reloading. Depending on the material used for construction of the apparatus, a variety of firearms may be used. For example, where paper or cardboard or similar material is used, recommended firearms include rifles, handguns, BB-guns, and pellet guns. Depending on the material used for construction, and the amount of use, the apparatus may be single-use or multiple-use.

After use, the product can moved in an assembled form, or may be collapsed, in whole or in part, for re-use, or it may be disposed of. In one embodiment, the side panels or wings can be folded inward to the front face, and secured thereto by the custom cutouts on the bottom of the box (by insertion of the stake tabs on the side panels in the cutouts), thereby allow the product to be moved in a convenient fashion while substantially assembled. Accordingly, the apparatus provides a simple, flexible, portable, easy-to-assemble target shooting system for recreational shooting and training.

DETAILED DESCRIPTION OF EXEMPLARY EMBODIMENTS

In various exemplary embodiments, the present system comprises a portable target shooting apparatus that is easily transported and constructed in the field, backyard, or other location for shooters to use for training and recreation. Portions of the apparatus comprise graphics for target shooting. In one embodiment, the invention further comprises a shelving system to support a variety of targets, including, but not limited to, three-dimensional targets such as fruit, cans, bottles, clay discs, or any similar item. The apparatus may be made of cardboard, stiff paper, plastic, Kevlar, wood, metal, Styrofoam, or similar materials, or combinations thereof.

Figure 1:
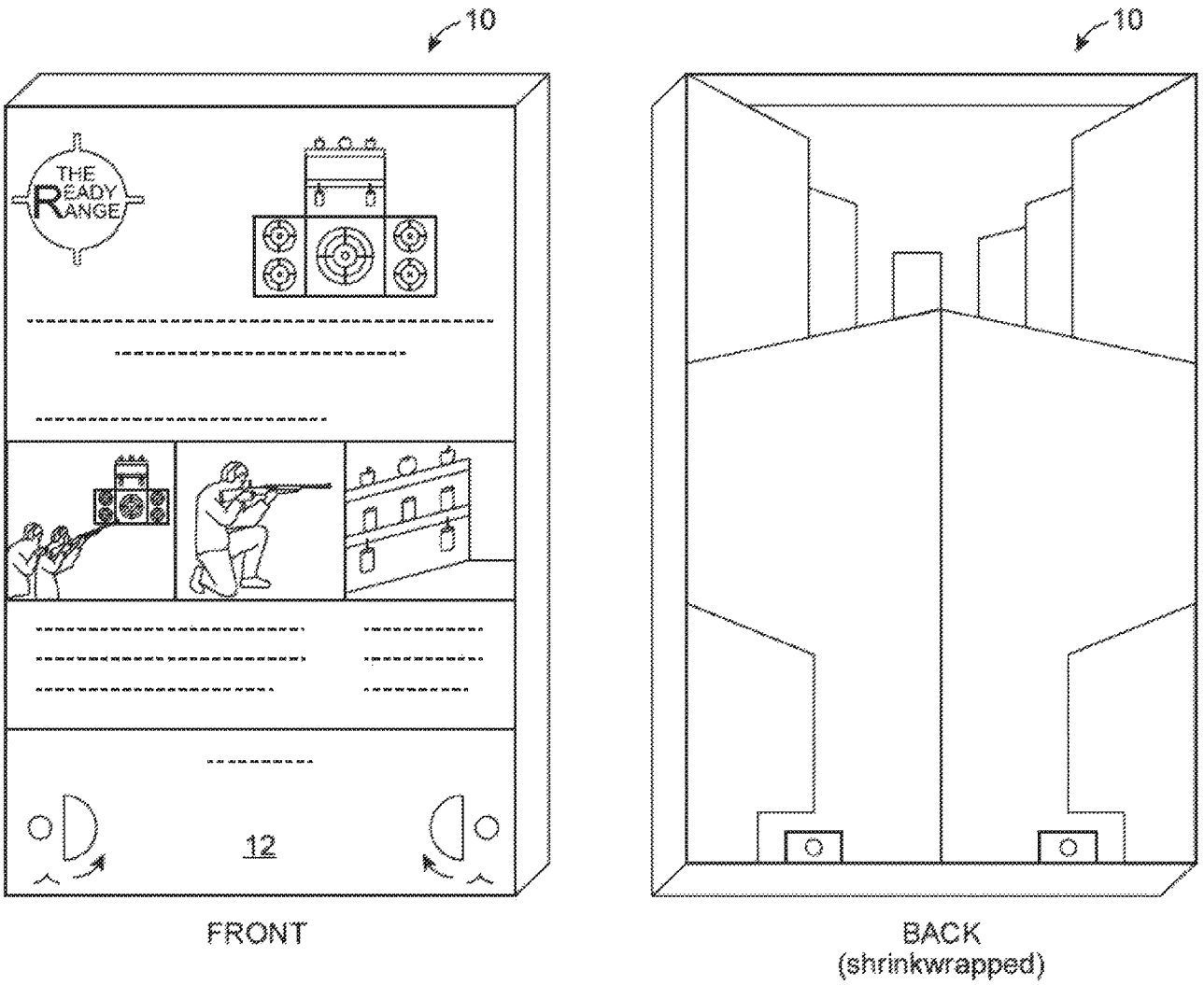
FIG. 1 shows front and back views of the portable shooting target in collapsed form.
Figure 4:
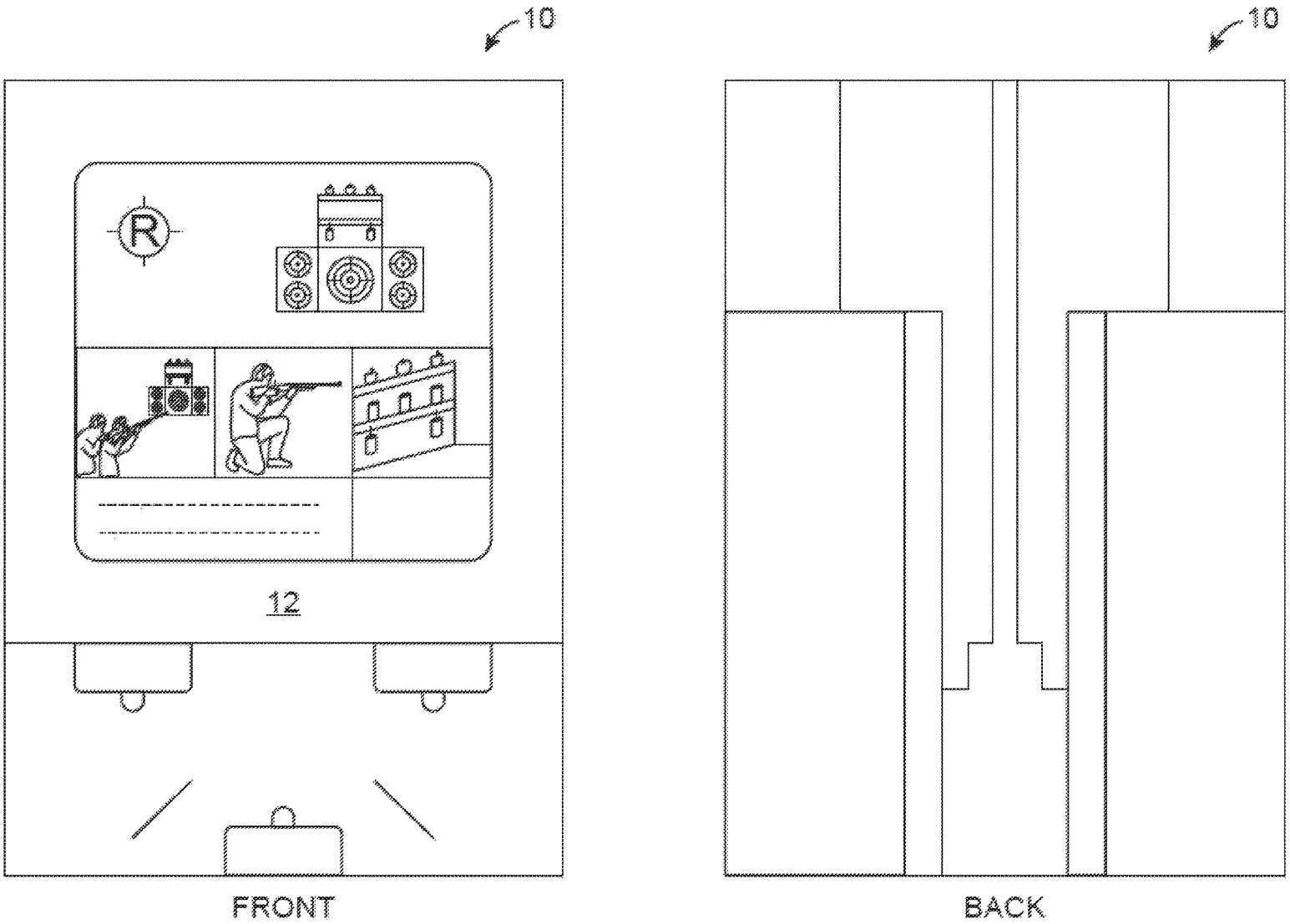
FIG. 4 shows front and back views of another embodiment of the portable shooting target in collapsed form.
Figure 5:
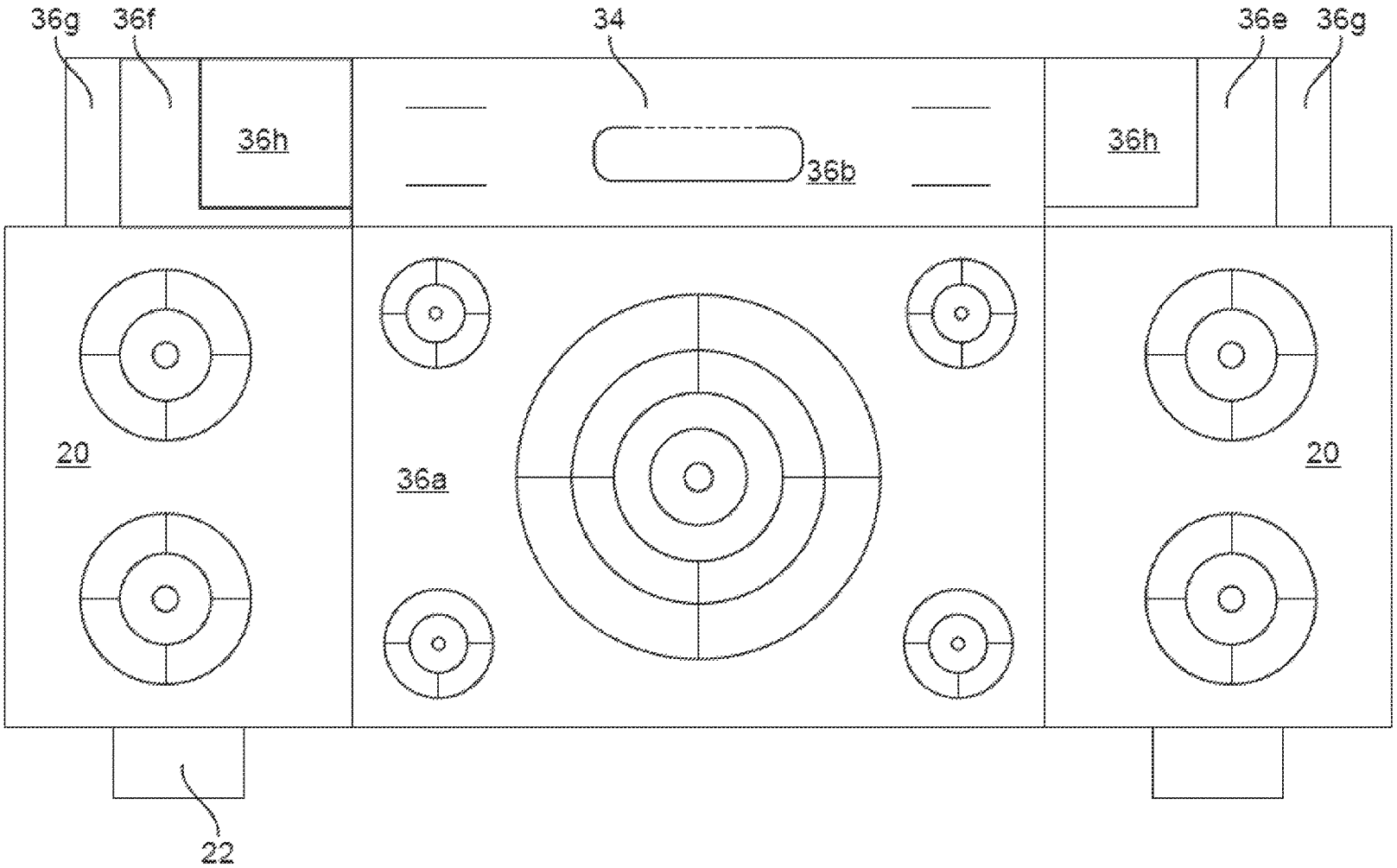
FIG. 5 shows a front view of another embodiment of the portable shooting target in a partially unfolded state.
Figure 6:
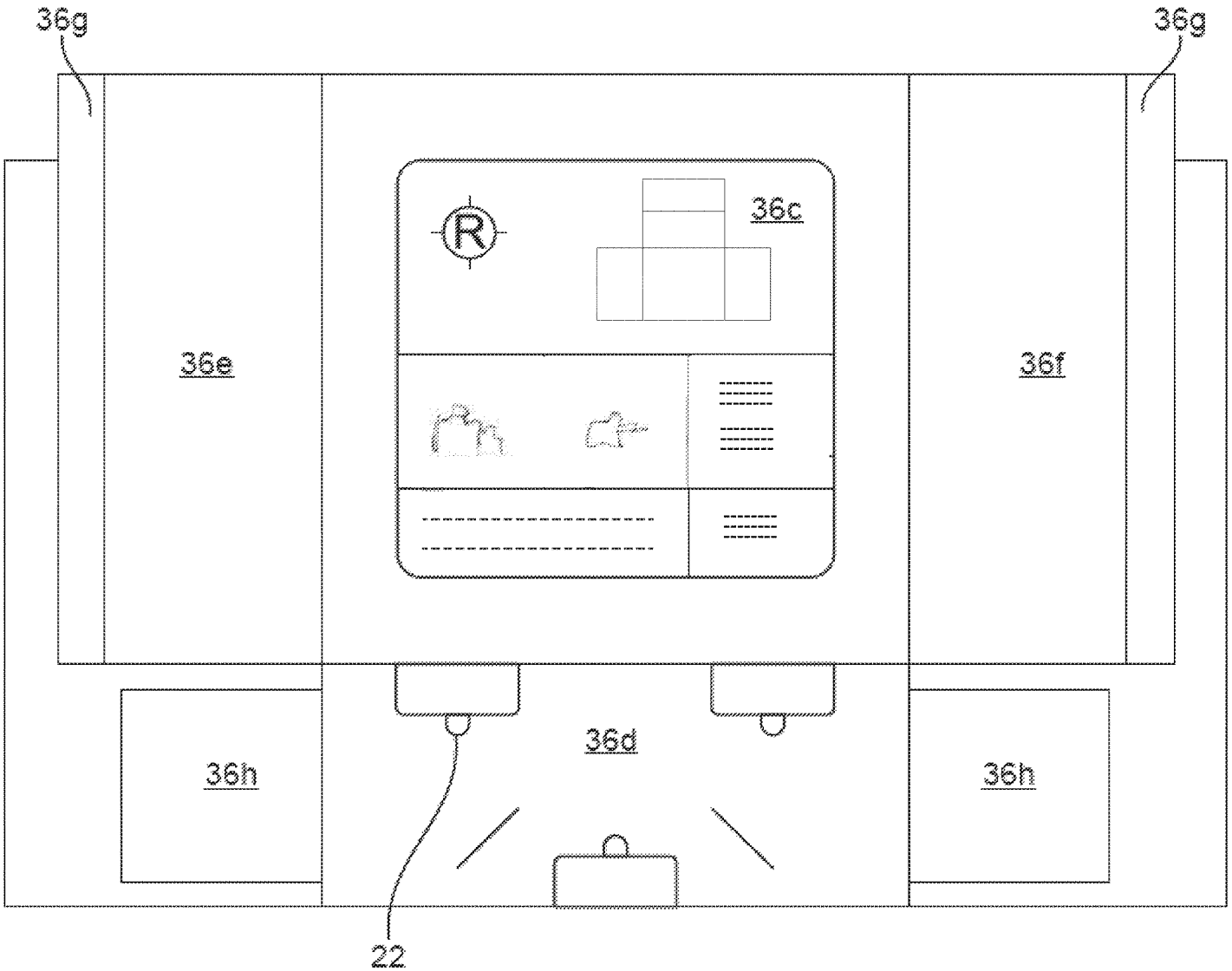
FIG. 6 shows a back view of the apparatus of FIG. 5.
Figure 7:
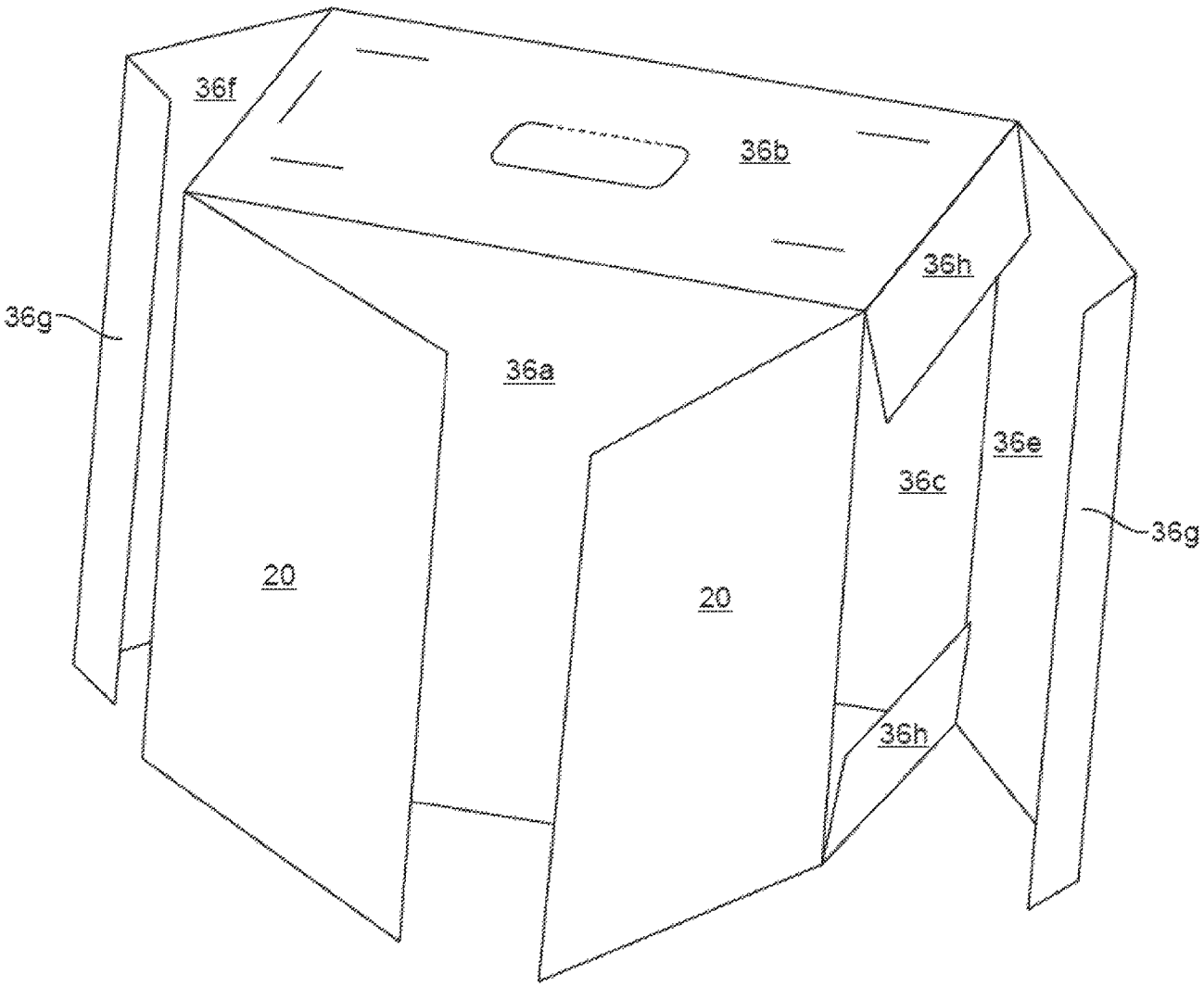
FIG. 7 shows a perspective view of a base in a partially assembled state.

FIGS. 1 and 4 show various embodiments of the apparatus in collapsed form 10. In collapsed form the apparatus is a relatively flat, lightweight package, easily carried by a single individual. It may be shrink wrapped, secured by packaging straps, or otherwise fastened so as not to prematurely open.

The apparatus may be self-merchandised in its collapsed state or in a partially assembled state, and thus can easily be displayed on a store shelf, gondola, or display apparatus. In the embodiment shown in FIG. 1, the back panel 12 of the box is the consumer-facing side when collapsed. The target and related graphics are substantially located on the interior faces. Additional components, such as, but not limited to, shelving, reinforcements, instructions, stakes, and toggles, may be folded into the back or interior of the product, and enclosed by the side panels.

Figure 2B:
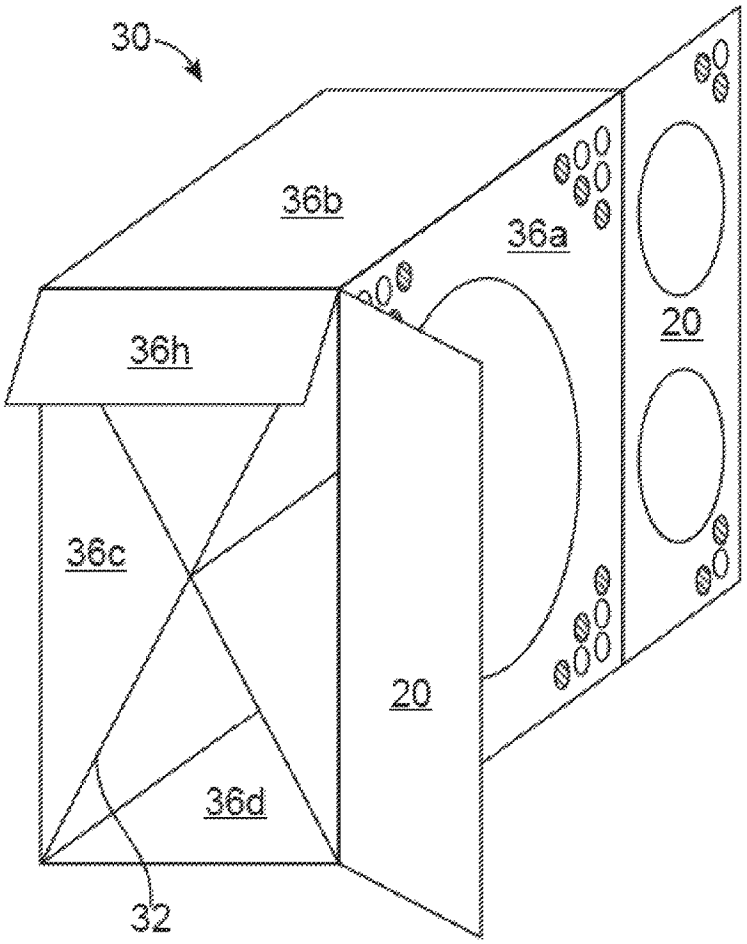
FIGS. 2A-D show the portable shooting target being assembled.
Figure 2A:
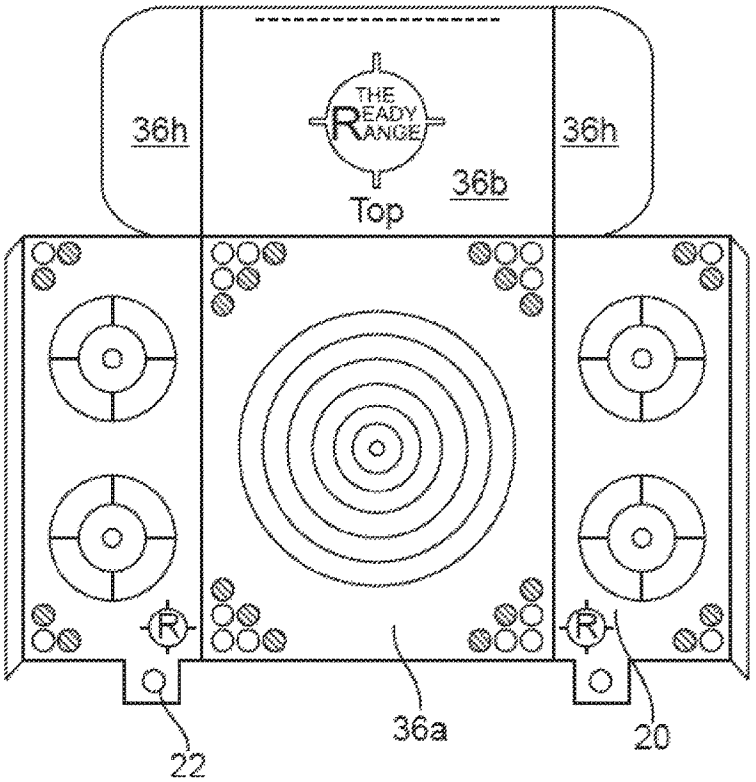
Figure 8:
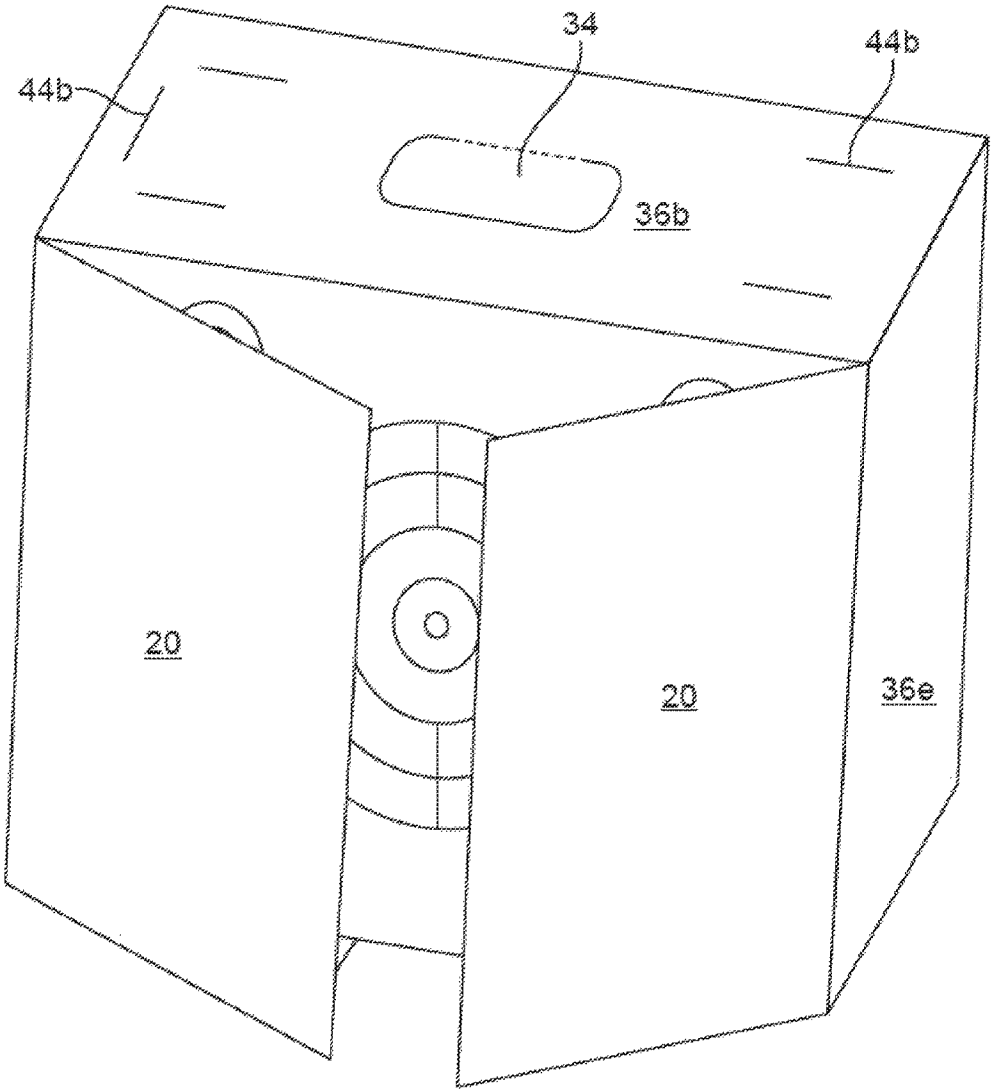
FIG. 8 shows a perspective view of the assembled base with side panels partially closed.
Figure 9:
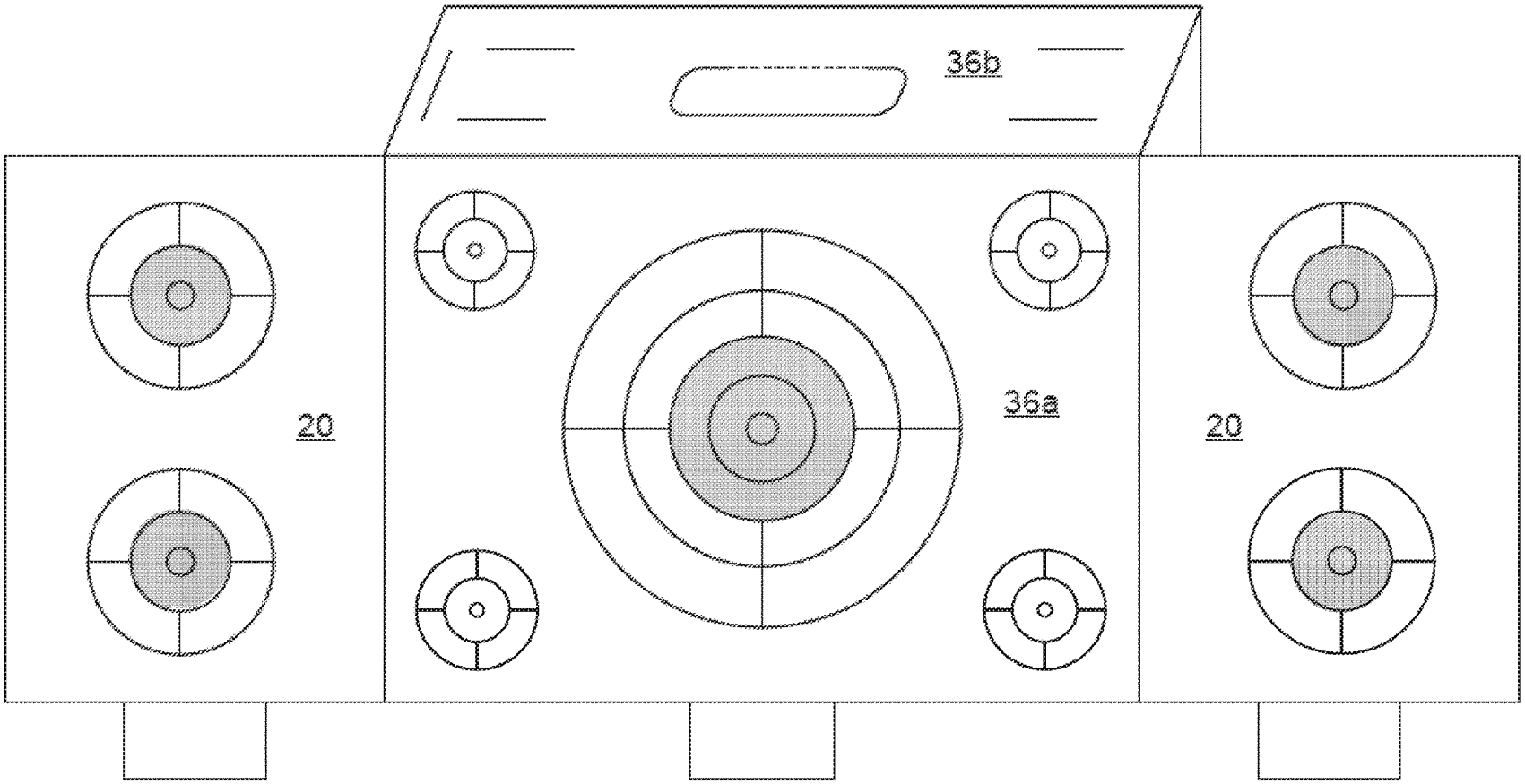
FIG. 9 shows a perspective view of the assembled base with side panels open.

The user transports the apparatus in collapsed form to the site, and begins assembly or construction. In one embodiment, as seen in FIGS. 2A-D, assembly or construction comprises unfolding the side panels (or wings) 20, and unfolding the reinforced support box 30 (which forms the base of the apparatus) (FIG. 2A). A reinforcement component 32 is contained in the box itself which folds into an X-shape and is inserted into the support box to reinforce it (FIG. 2B). In alternative embodiments, a reinforcement component is not provided. Tabs 22, which may or may not have pre-cut slots or holes, extend from the bottom of the side panels and the support box (and may extend from front, back, or sides), and stakes 24 can be inserted through one or more of said tabs to secure the apparatus to the ground (FIG. 2C). Where no holes are provided, the stakes are driven through the tabs directly. Alternatively, the apparatus may be weighted with stones, bricks, sand, or the like placed on the tabs or in the interior of the support box. A handle, hole, or grip 34 may be provided to assist in carrying the apparatus when assembled, as seen in FIG. 8.

FIGS. 5-9 show the unfolding and assembly of another embodiment of the support box or base 30. The support box generally comprises a front face 36*a*, a top 36*b*, a back face 36*c*, and a bottom 36*d*, contiguously attached along their respective edges, which fold and allow the box to collapse. In this embodiment, the side panels 20 are foldingly attached to the right and left edges of the front face 36*a*. The right face 36*e* and left face 36*f* of the box (when assembled) are contiguously attached along one edge to the right and left edges of the back face 36*c*. The right and left faces each comprise a folding insert 36*g* along the edge opposite the edge attached to the back face. Flaps 36*h* extend from the ends of the top face and bottom face, and during assembly, these are folded inward, the corresponding right or left face is folded over the flaps, and the folding insert is inserted into the space behind the front face to form the side of the box.

Figure 2D:
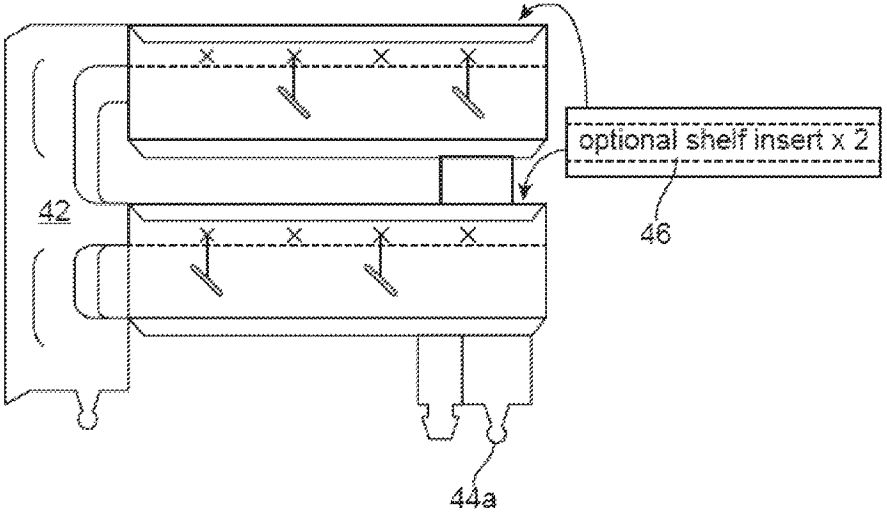
Figure 2C:
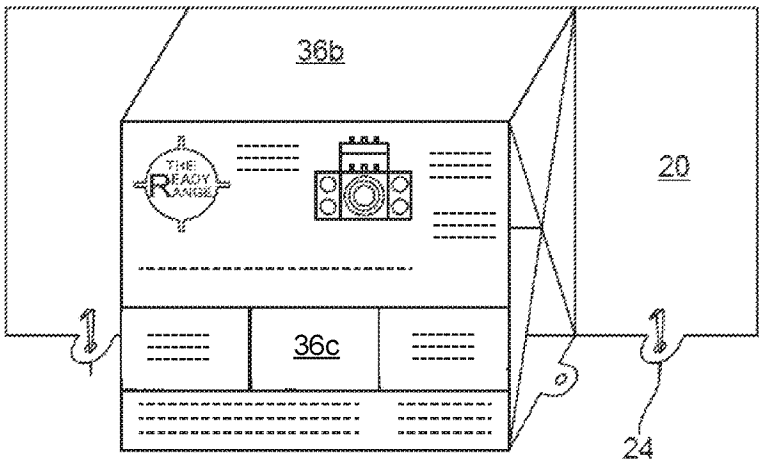
Figure 10:
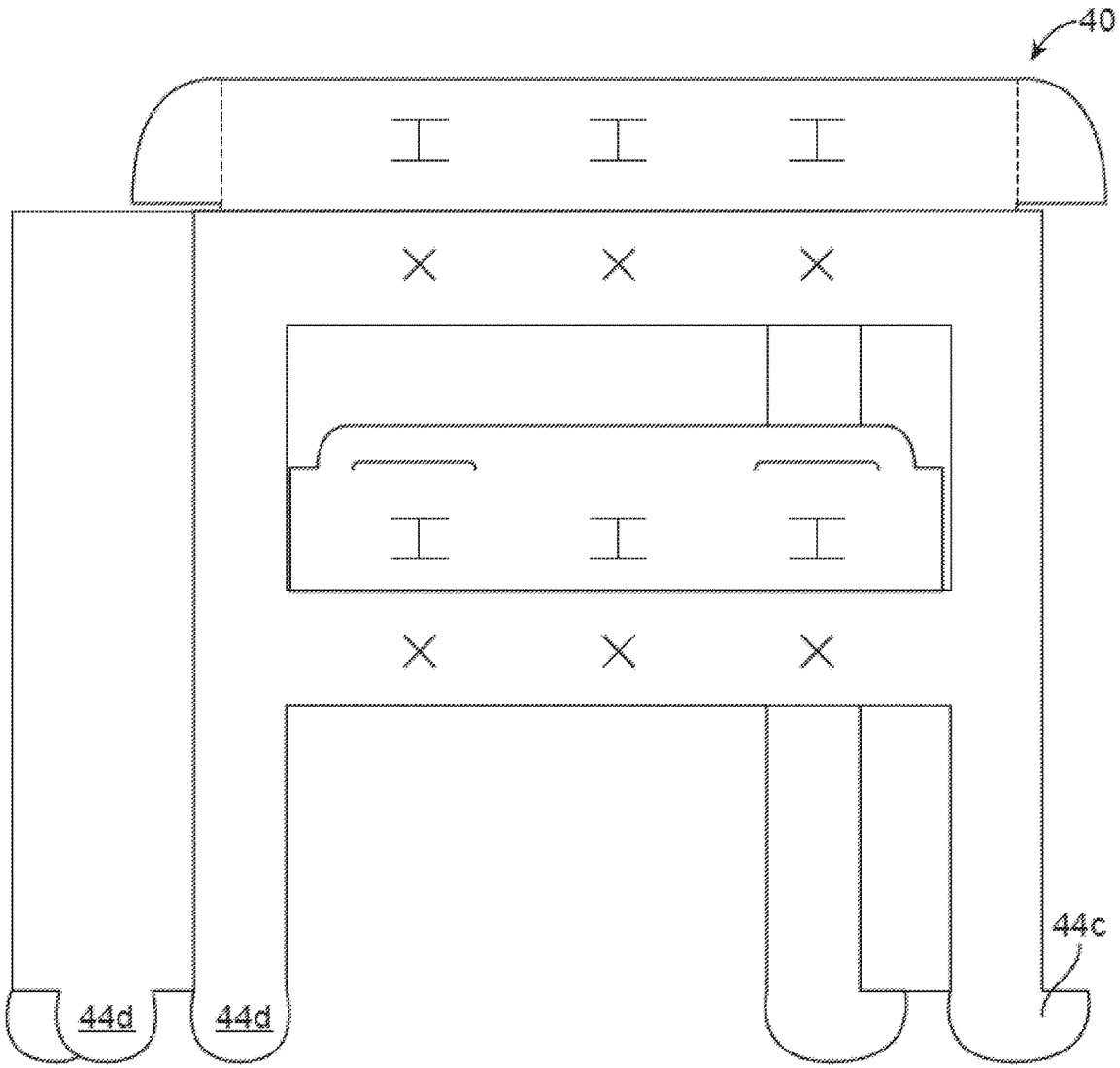
FIG. 10 shows a front view of another embodiment of a shelf unit in a partially unfolded state.
Figure 11:
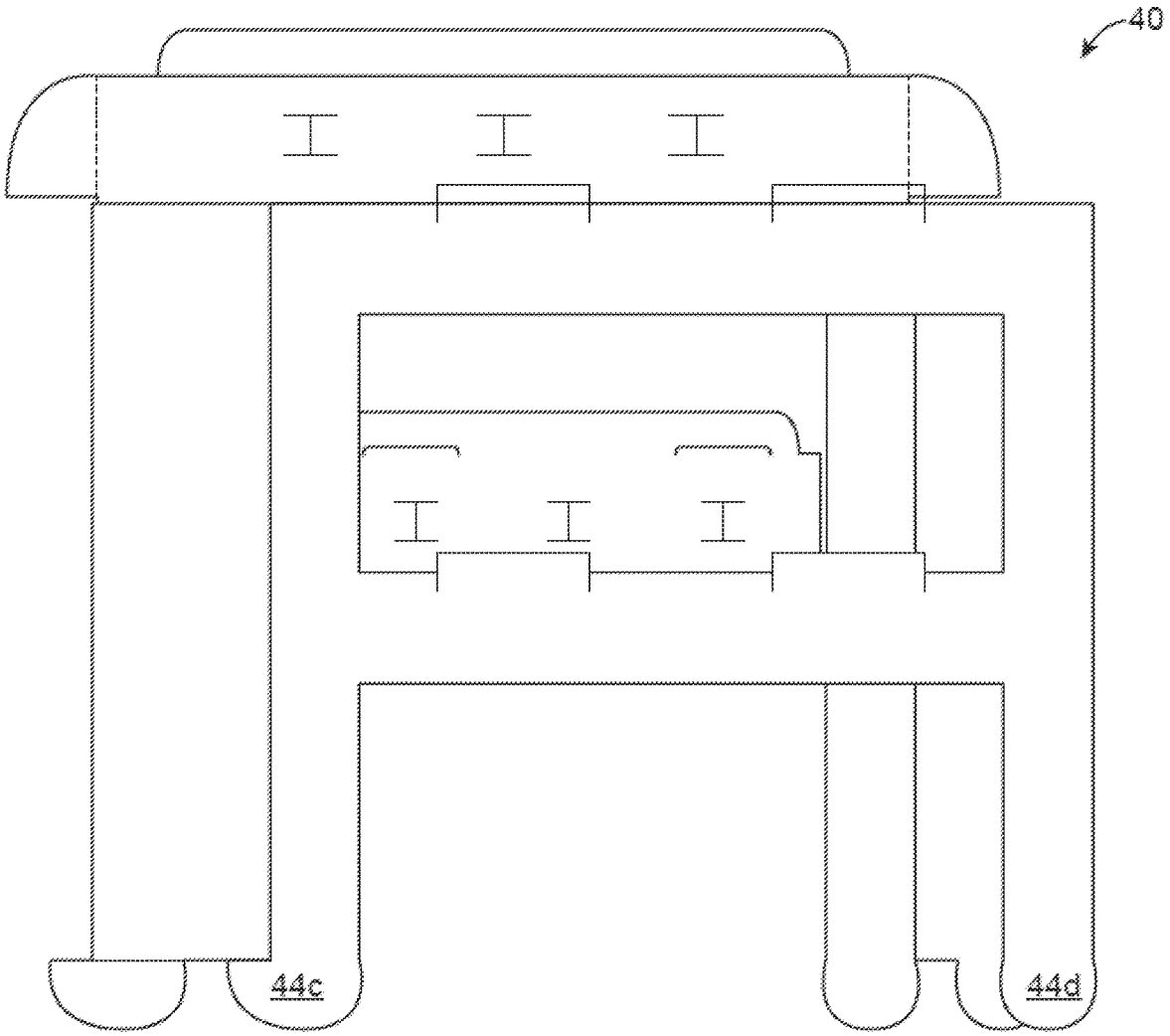
FIG. 11 shows a back view of the shelf unit of FIG. 10.
Figure 12:
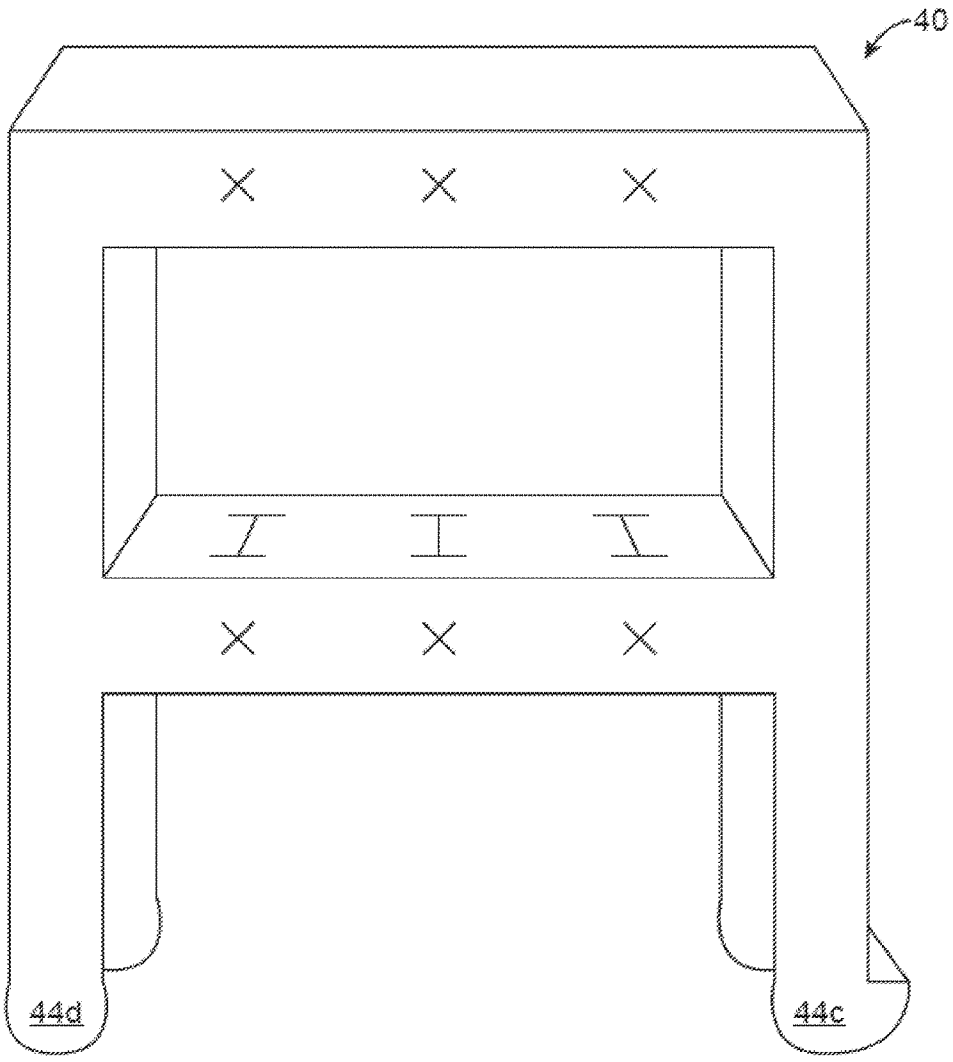
FIG. 12 shows a perspective view of the assembled shelf unit.

If desired, the shelf unit 40 may be unfolded, and tabs 44*a* at the bottom of the side supports 42 inserted into matching tabs, holes or slots 44*b* in the top of the support box so that the shelf is secured on top of the support box (as seen in FIG. 2D). In one embodiment, shelf inserts 46 may be used with the shelving unit. FIGS. 10 and 11 show an alternative embodiment of the shelf unit when folded, where the shelf tops are folding attached to the front of crosspieces between the side supports, and are folded back with tabs inserted into matching slots on back crosspieces. FIG. 12 shows the shelf unit when assembled. In this embodiment, there are two tabs 44*c* on one end of the shelf unit with an elongated end (for more secure fastening) to be inserted first, with three straighter tabs 44*d* on the other end of the shelf unit.

Figure 3:
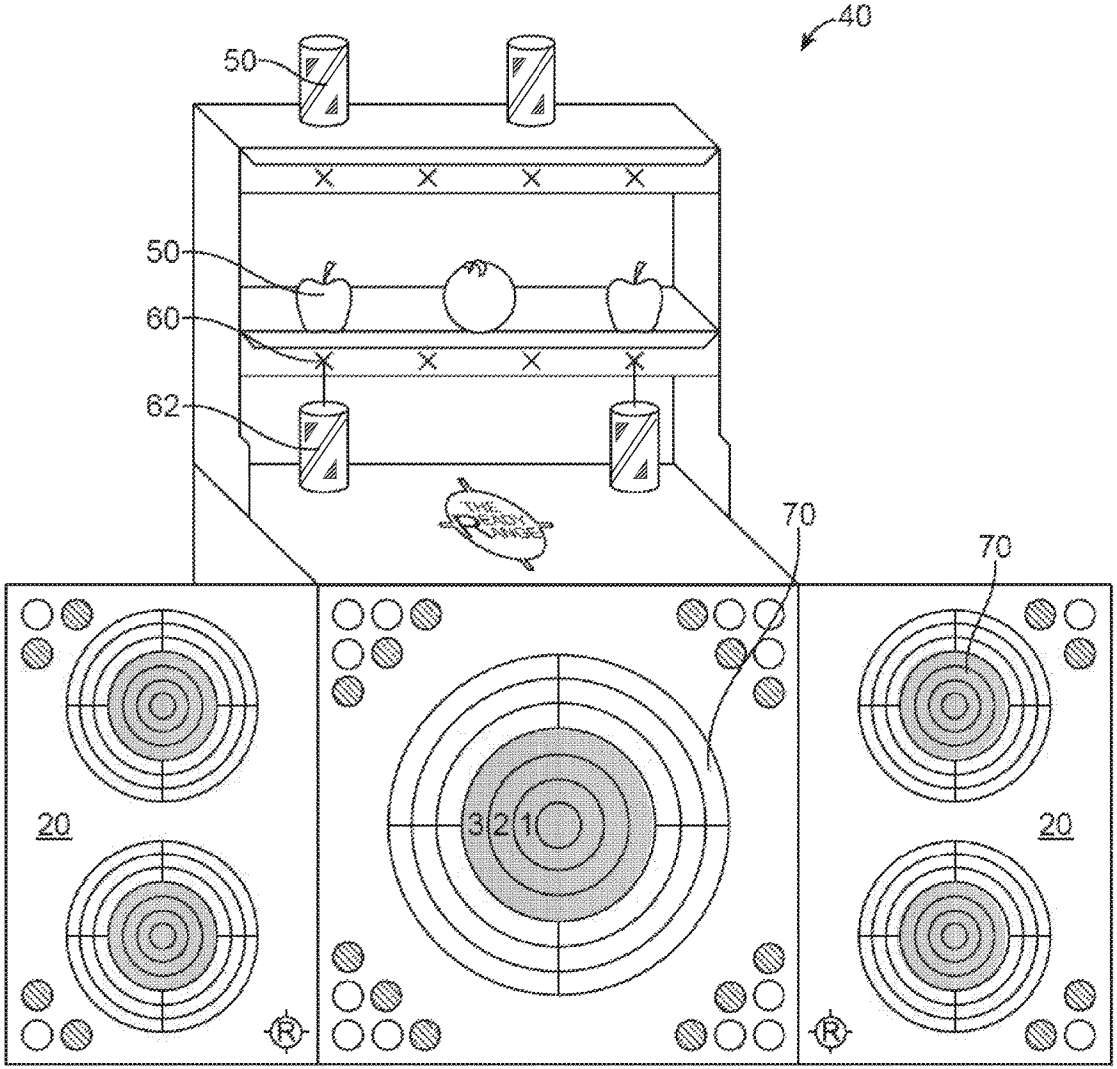
FIG. 3 shows the assembled portable shooting target.
Figure 13:
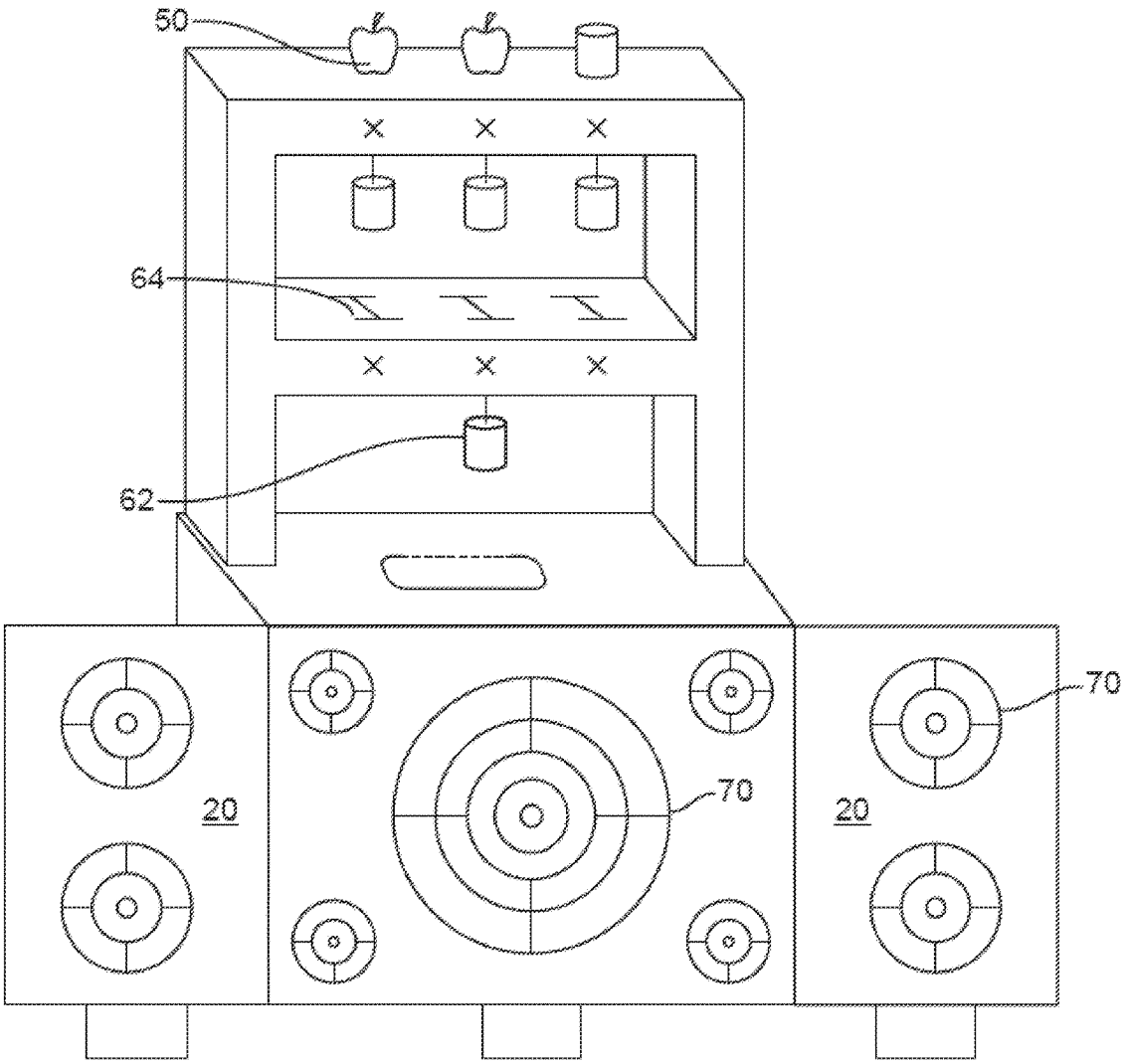
FIG. 13 shows a perspective view of another embodiment of the assembled portable shooting target.

FIGS. 3 and 13 show two embodiments of the apparatus fully constructed, complete with shelving unit 40 and three-dimensional targets or objects 50 (e.g., cans, fruit) placed thereon. In several embodiments, one or more hooks or holes 60 are provided to allow targets 62 (such as cans, and the like) to be suspended by hanging toggles, string or wire. As seen in FIG. 13, the top of a shelf also may comprise one or more holes or slots 64 to support clay discs, targets, or similar objects 66.

A variety of shooting target graphics 70 are displayed on the front of the support box and the side panels, as shown. Graphics may be pre-printed on the apparatus. Alternatively, adhesive graphics or the like may be placed (or re-placed) on the apparatus. In one embodiment, replaceable graphics on a heavy card stock or similar material is slid or inserted into place on the apparatus and fastened in place.

Figure 14:
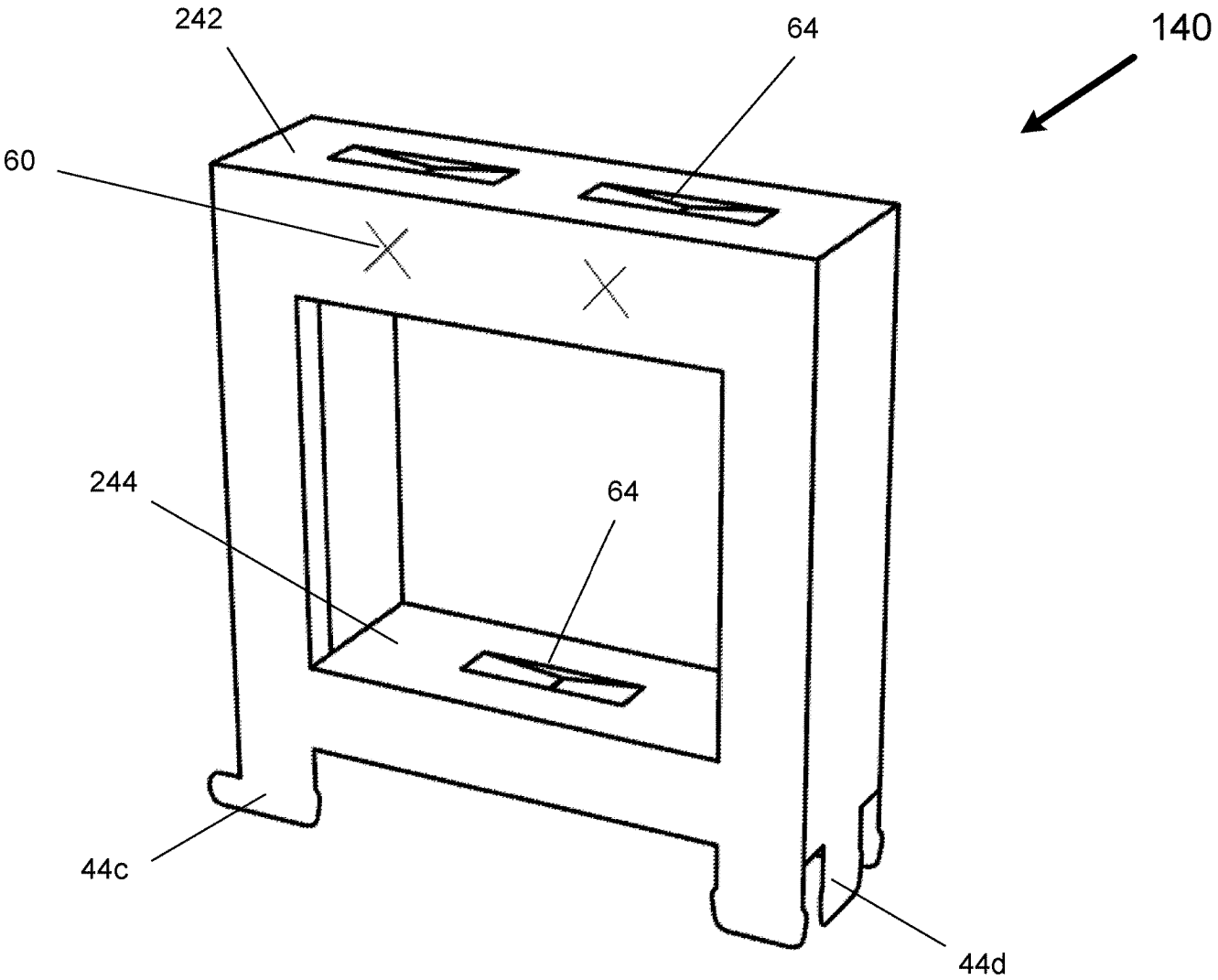
FIG. 14 shows a right front perspective view of another embodiment of an assembled shelf unit.
Figure 15:
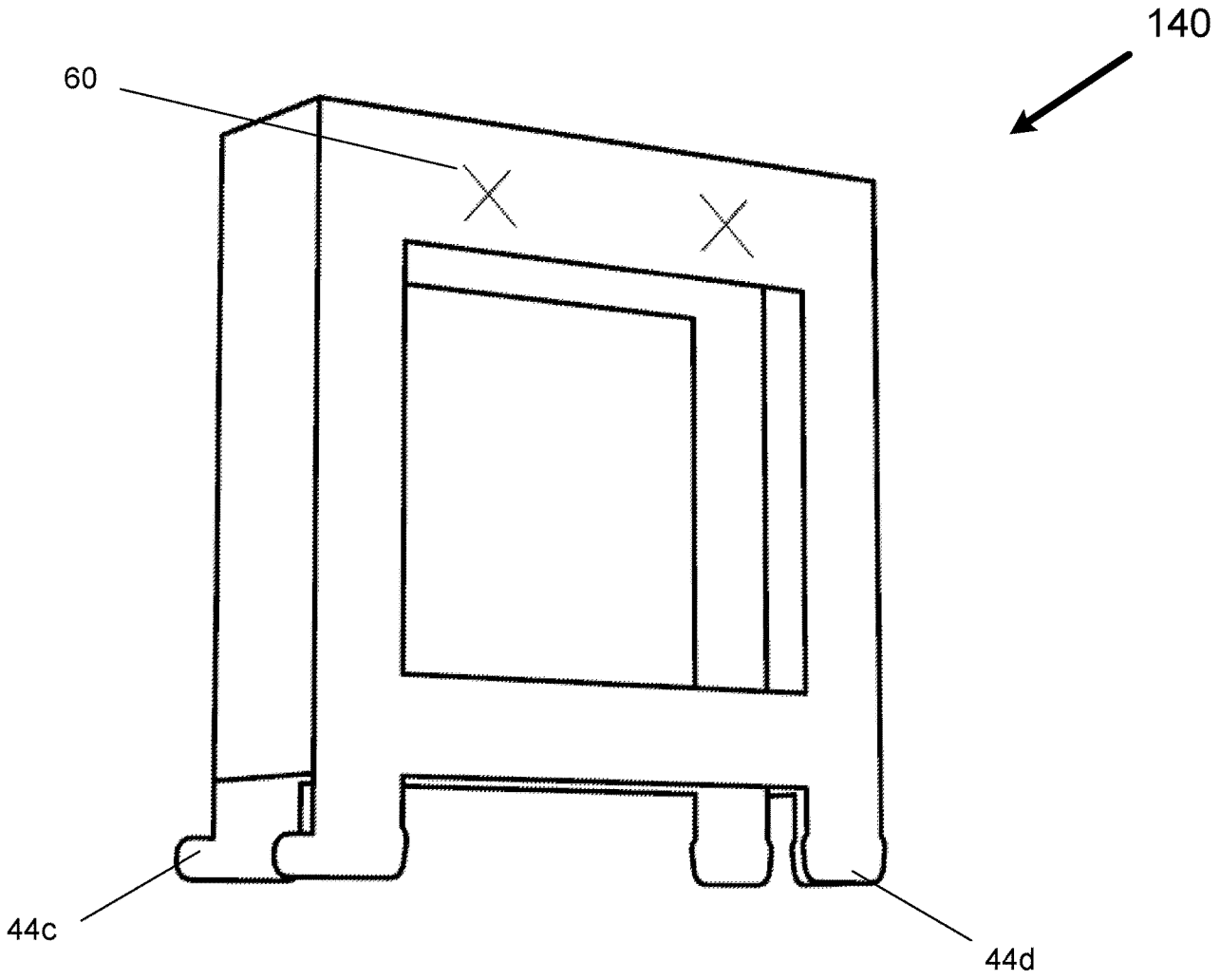
FIG. 15 shows a left front perspective view of the shelf unit of FIG. 14.

FIGS. 14-33 show an alternative embodiment of the present invention. FIGS. 14-15 show a shelf unit 140 with an upper shelf 242 and a lower shelf 244. Two tabs 44*c* on one end of the shelf unit have an elongated end (for more secure fastening) to be inserted first, with three straighter tabs 44*d* on the other end of the shelf unit, as described above. Both the upper shelf and lower shelf have one or more target-supporting holes or slots 64, as described above, and the upper shelf comprises one or more hooks or holes 60 to suspend other targets.

Figure 16:
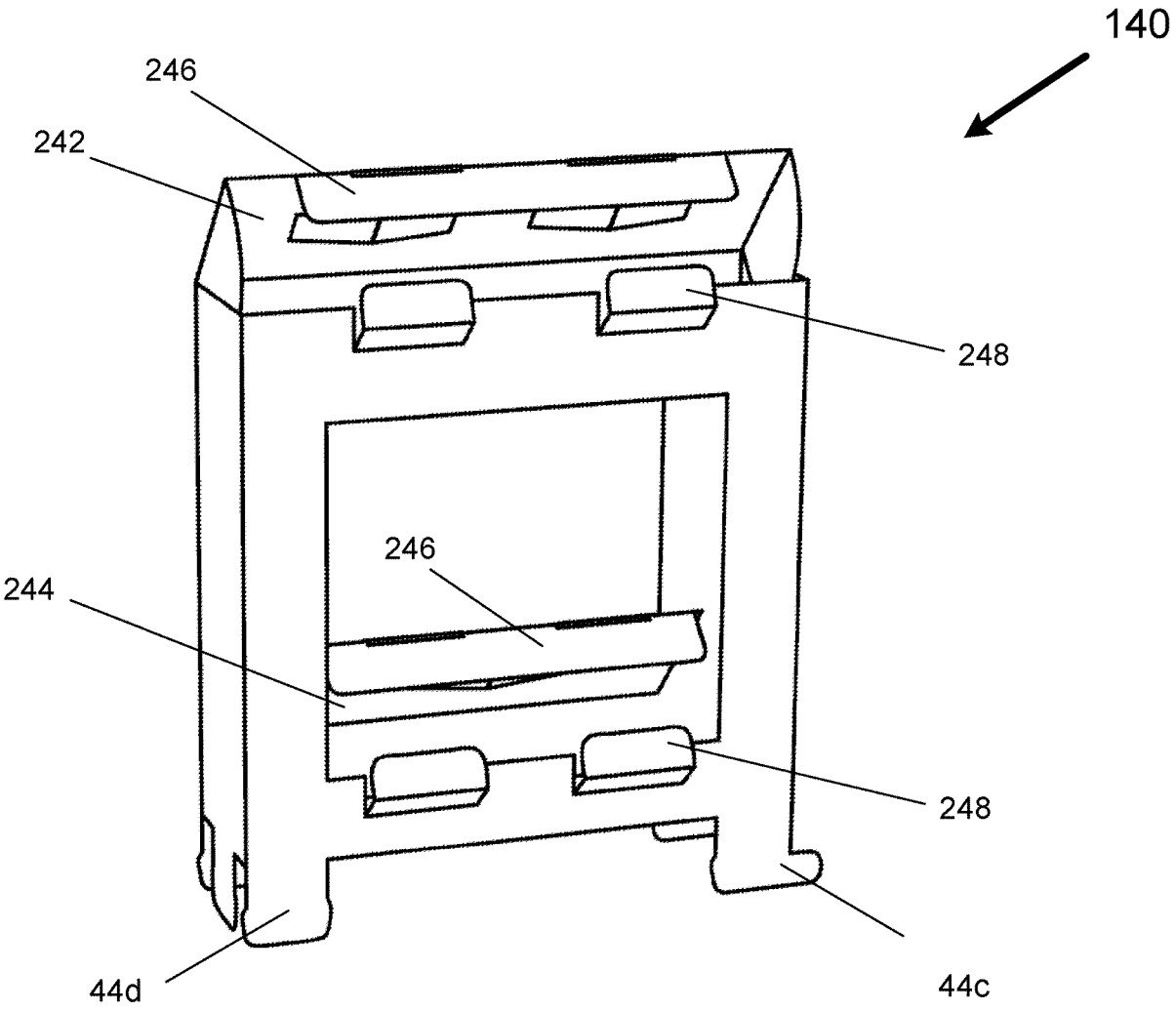
FIG. 16 shows a back view of the shelf unit of FIG. 14 partially unfolded or unassembled.
Figure 17:
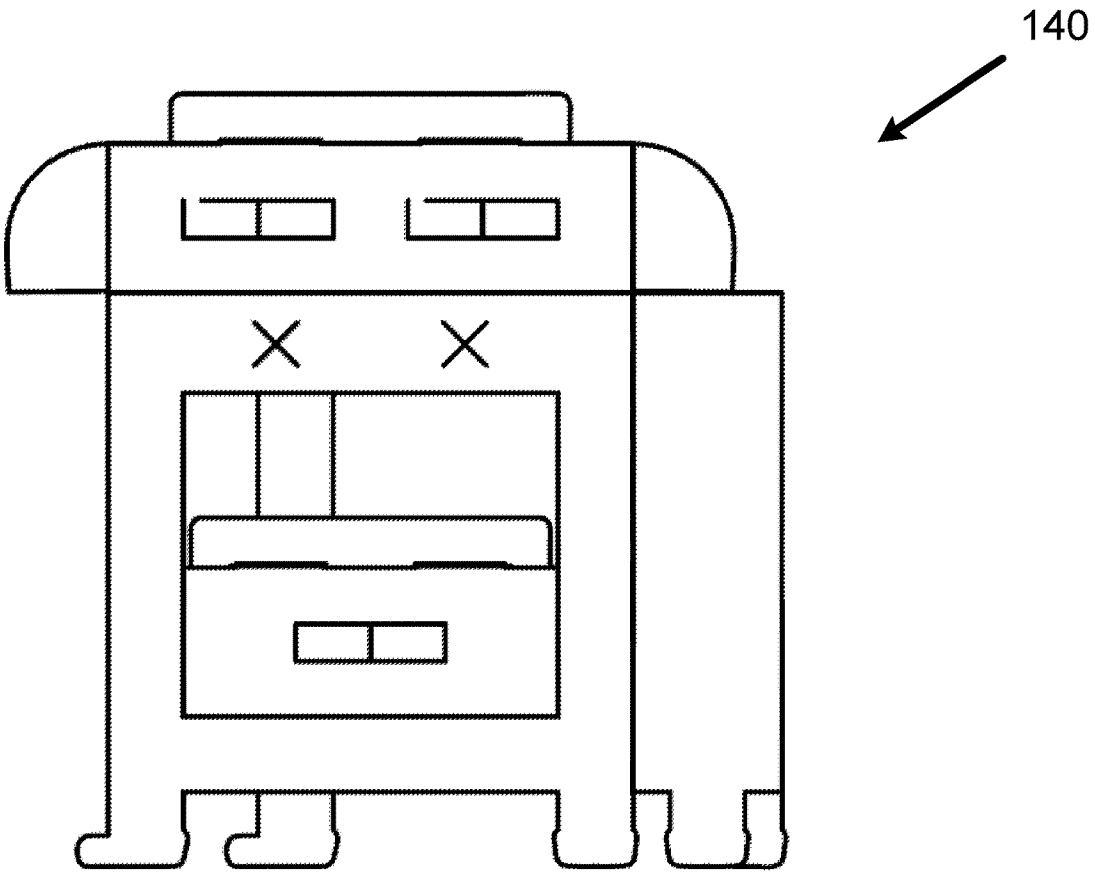
FIG. 17 shows a front view of the shelf unit of FIG. 14 in a flattened configuration.
Figure 18:
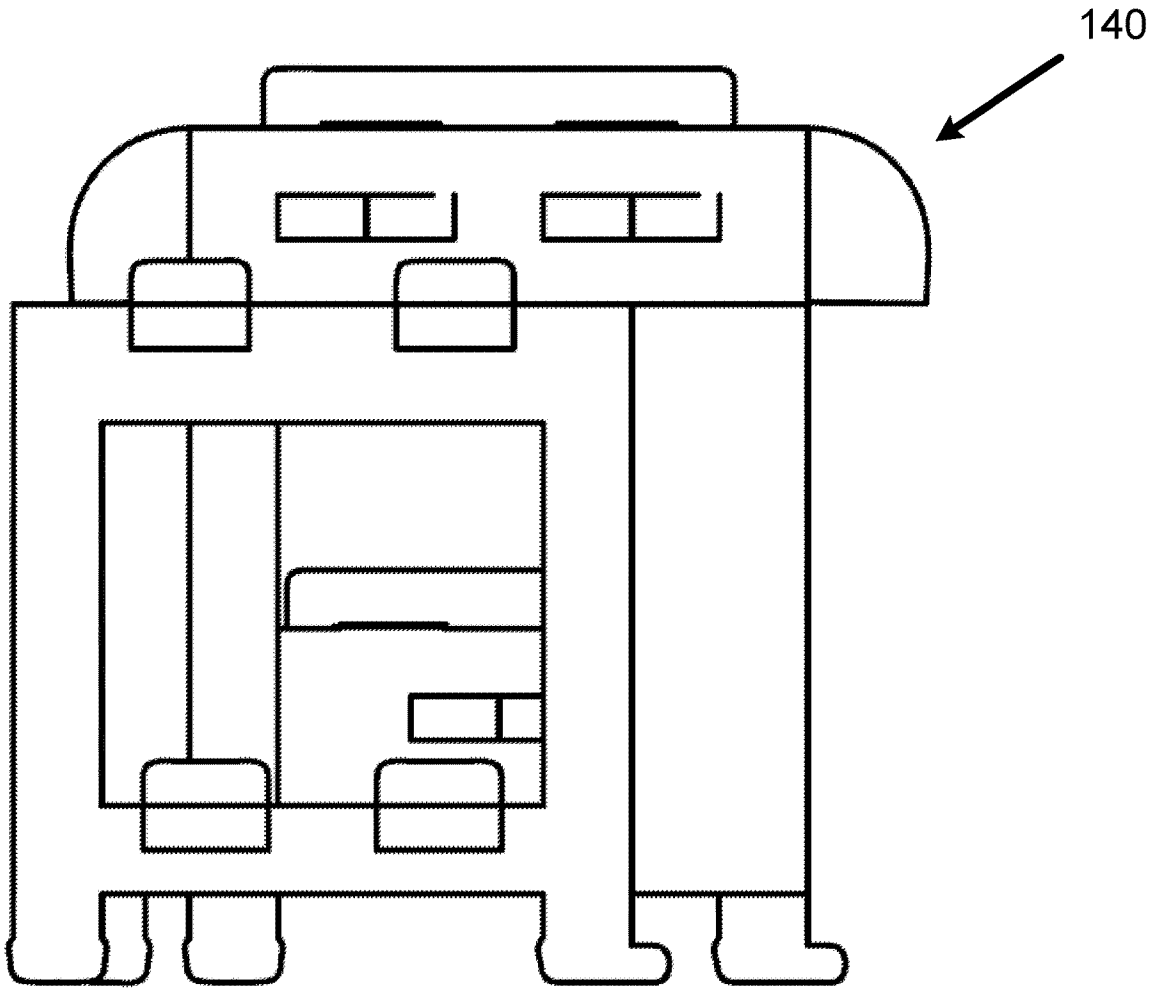
FIG. 18 shows a back view of the shelf unit of FIG. 14 in a flattened configuration.

FIG. 16 shows the shelf unit 140 is a partially unfolded state from the back. The upper shelf and lower shelf have been folded upward along a hinge with the front face of the shelf unit. A long tab 246 extends along the back of the each of the upper shelf and lower shelf, and tuck into and along the back face of the shelf unit when assembled. One or more locking flaps 248 are inserted into corresponding slots at the upper part of the corresponding long tab 246. End tabs at the end of the shelves fold down and into the shelf unit along the side faces when assembled. All components can be fully unfolded into a flattened configuration, as seen in FIGS. 17 and 18.

Figure 19:
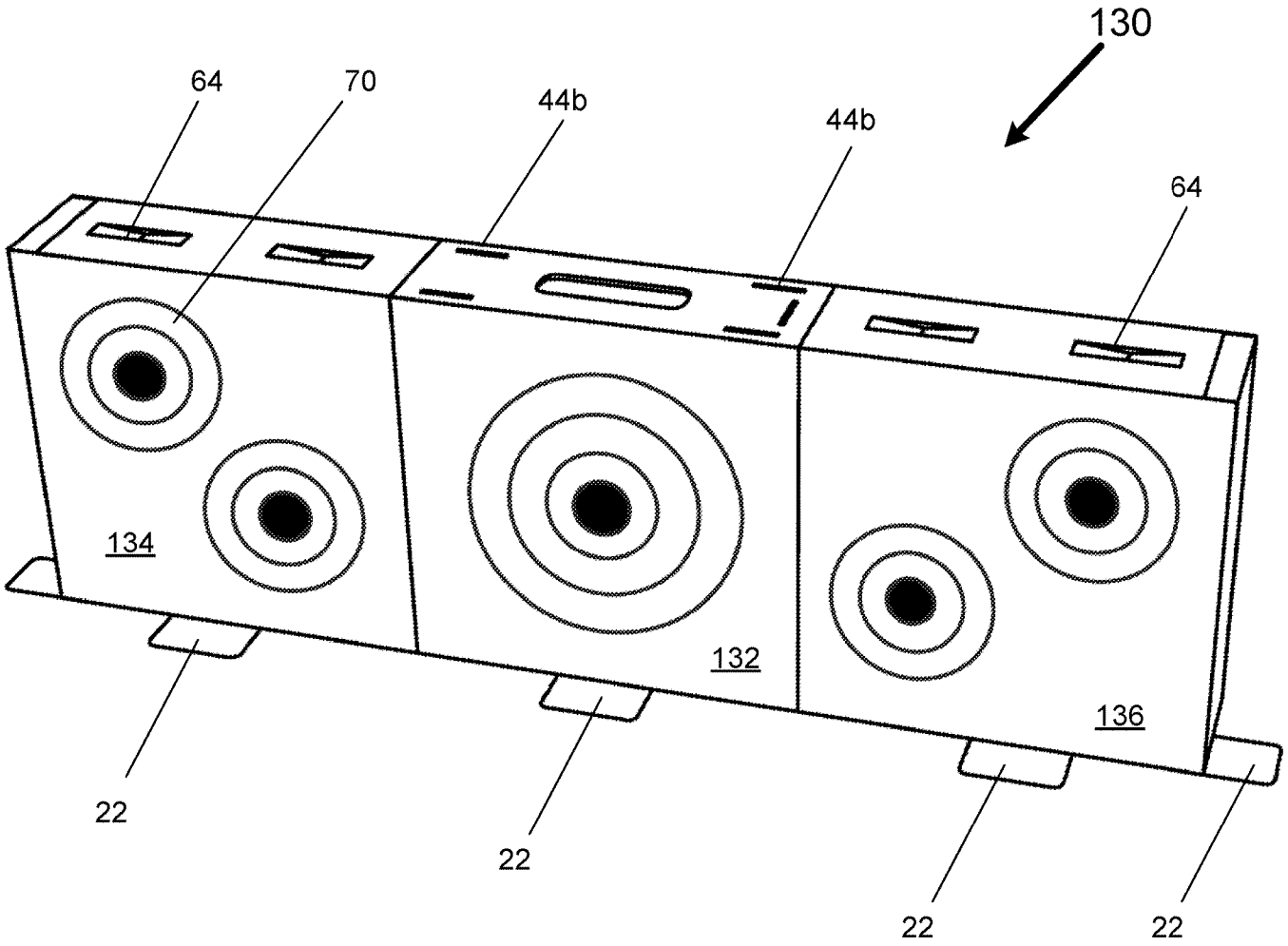
FIG. 19 shows a right front perspective view of another embodiment of a base unit.
Figure 20:
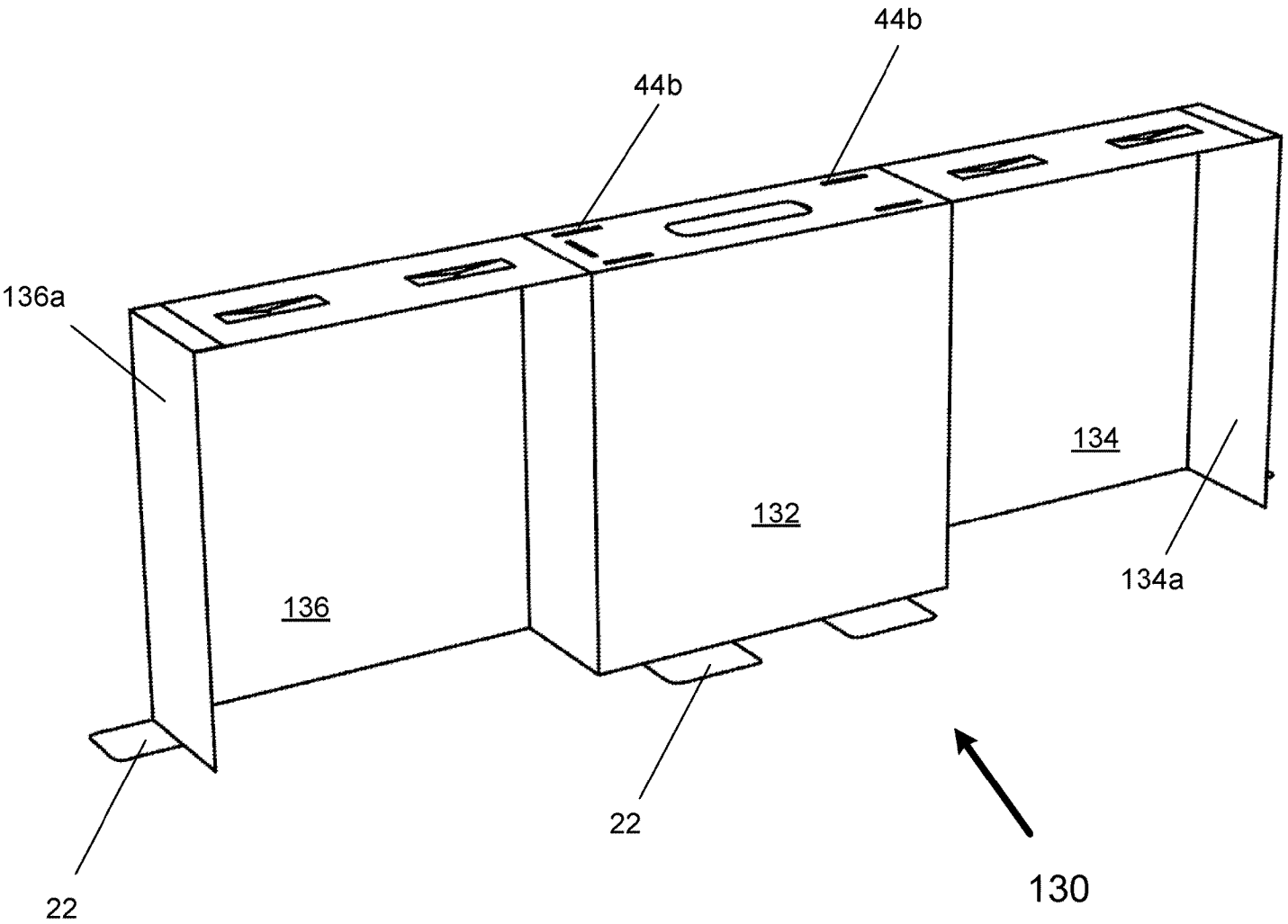
FIG. 20 shows a back view of the base unit of FIG. 19.

FIGS. 19-20 show another embodiment of a base unit 130. The base unit comprises a central base unit 132 with contiguous right 134 and left 136 base units. When assembled, the front face of all three base units are in the same plane. The base units can fold along the edges between the adjacent base units.

Figure 21:
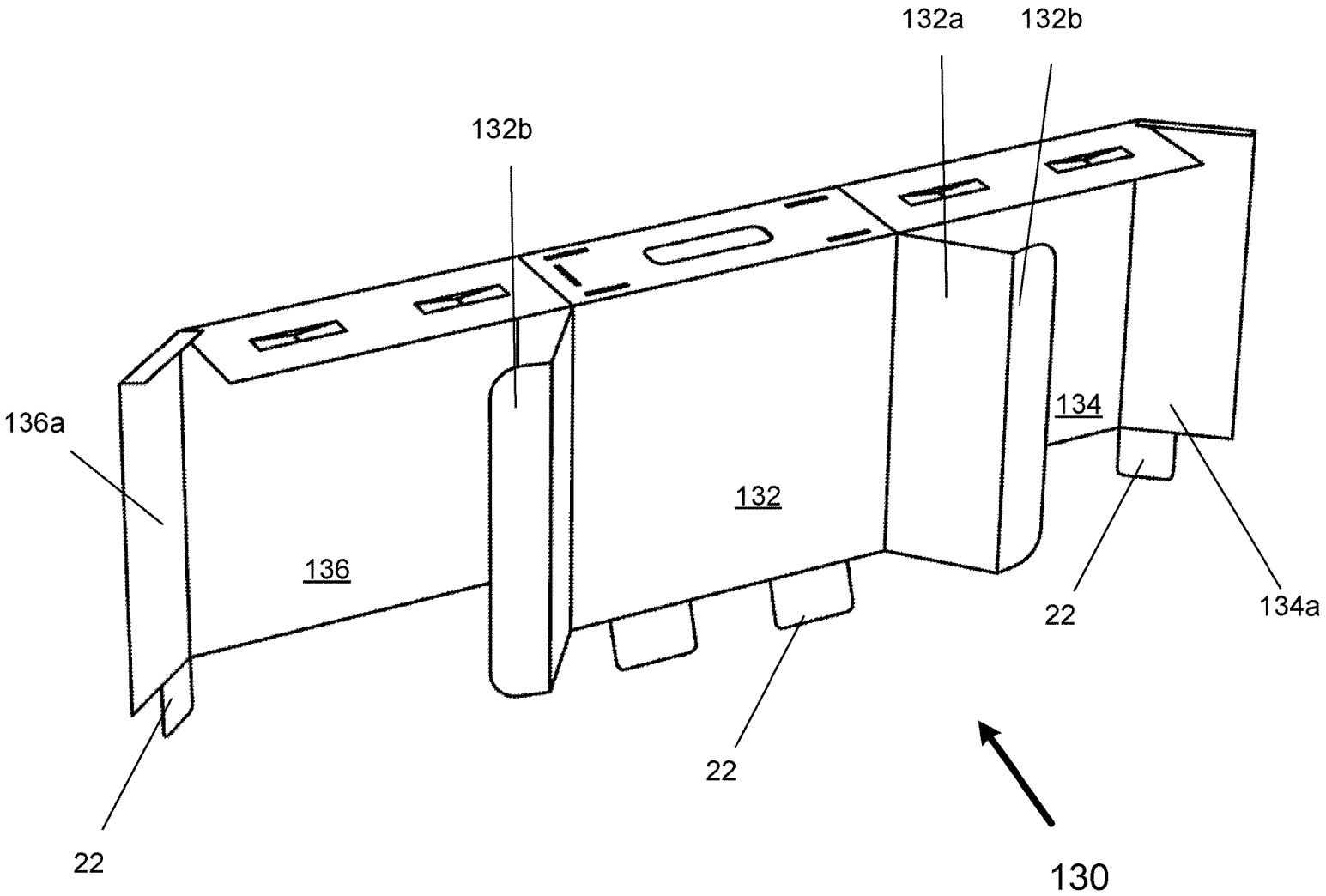
FIG. 21 shows a back view of the base unit of FIG. 19 partially unfolded or unassembled.
Figure 22:
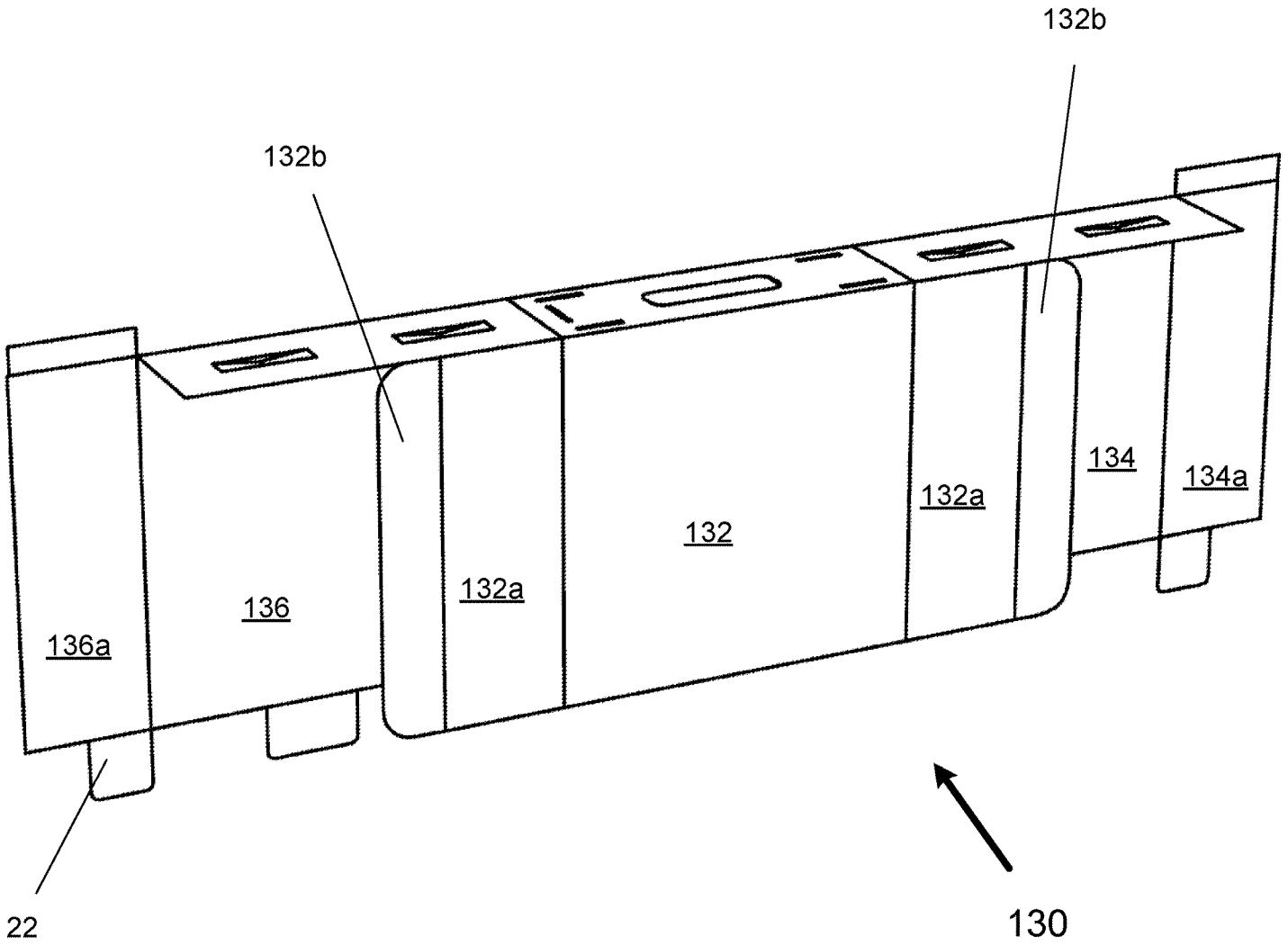
FIG. 22 shows a back view of the base unit of FIG. 19 in an unfolded configuration.

When fully assembled and unfolded, the central base unit comprises a box. In the embodiment shown, the central box has six sides (front, back, top, bottom, right and left sides). The right and left sides 132*a* fold along the connecting edge with the back face, as seen in FIG. 21. Securing flaps 132*b*, which fold along the connecting edge with the sides, tuck into and along the front face when assembled.

The right and left base units extend to either side of the central base unit. The right and left base units each have a top, foldingly connected along the edge to the front of each unit. Each top may comprise one or more target-supporting holes or slots 64, as described above.

Figure 23:
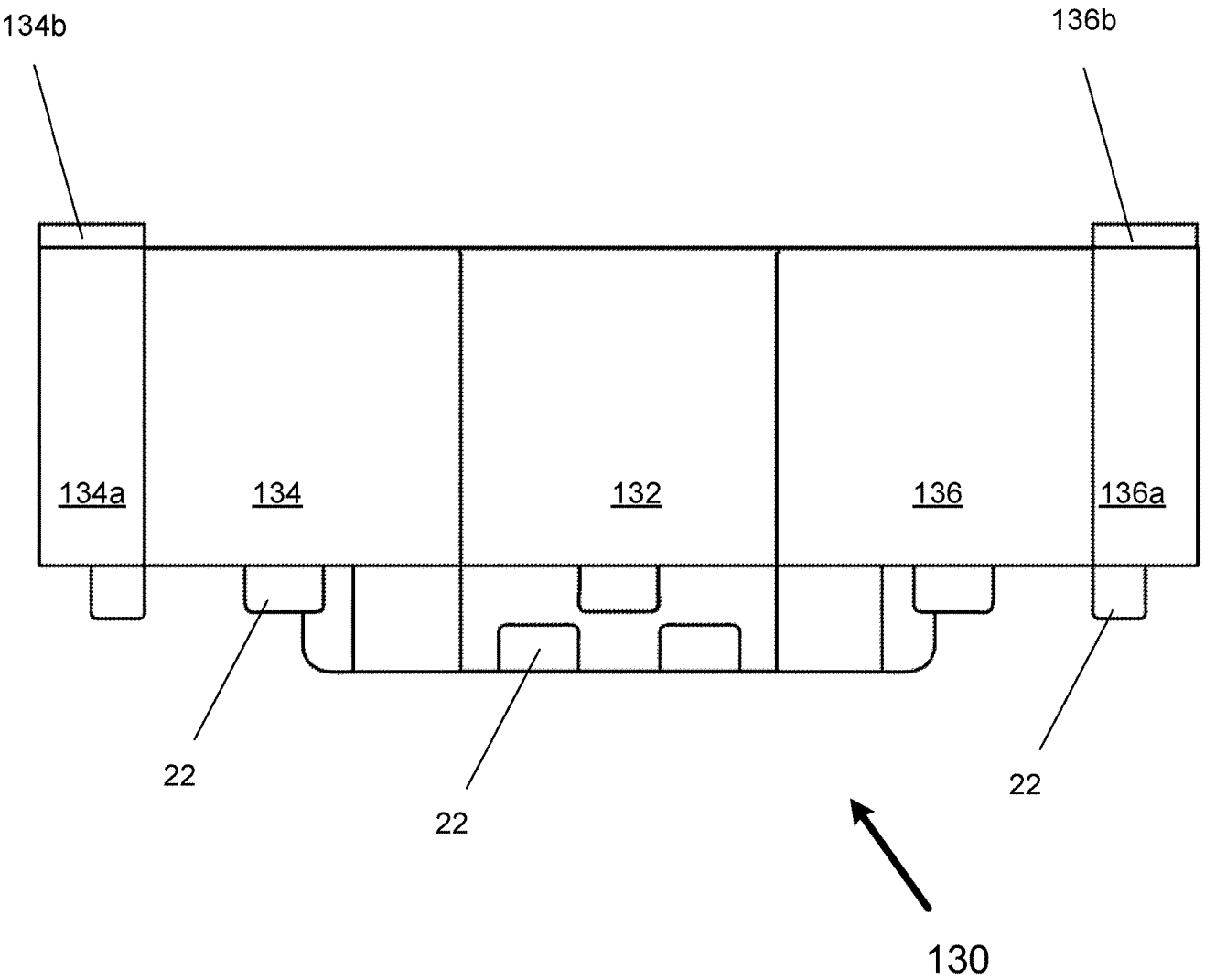
FIG. 23 shows a front view of the base unit of FIG. 19 in a flattened configuration.
Figure 24:
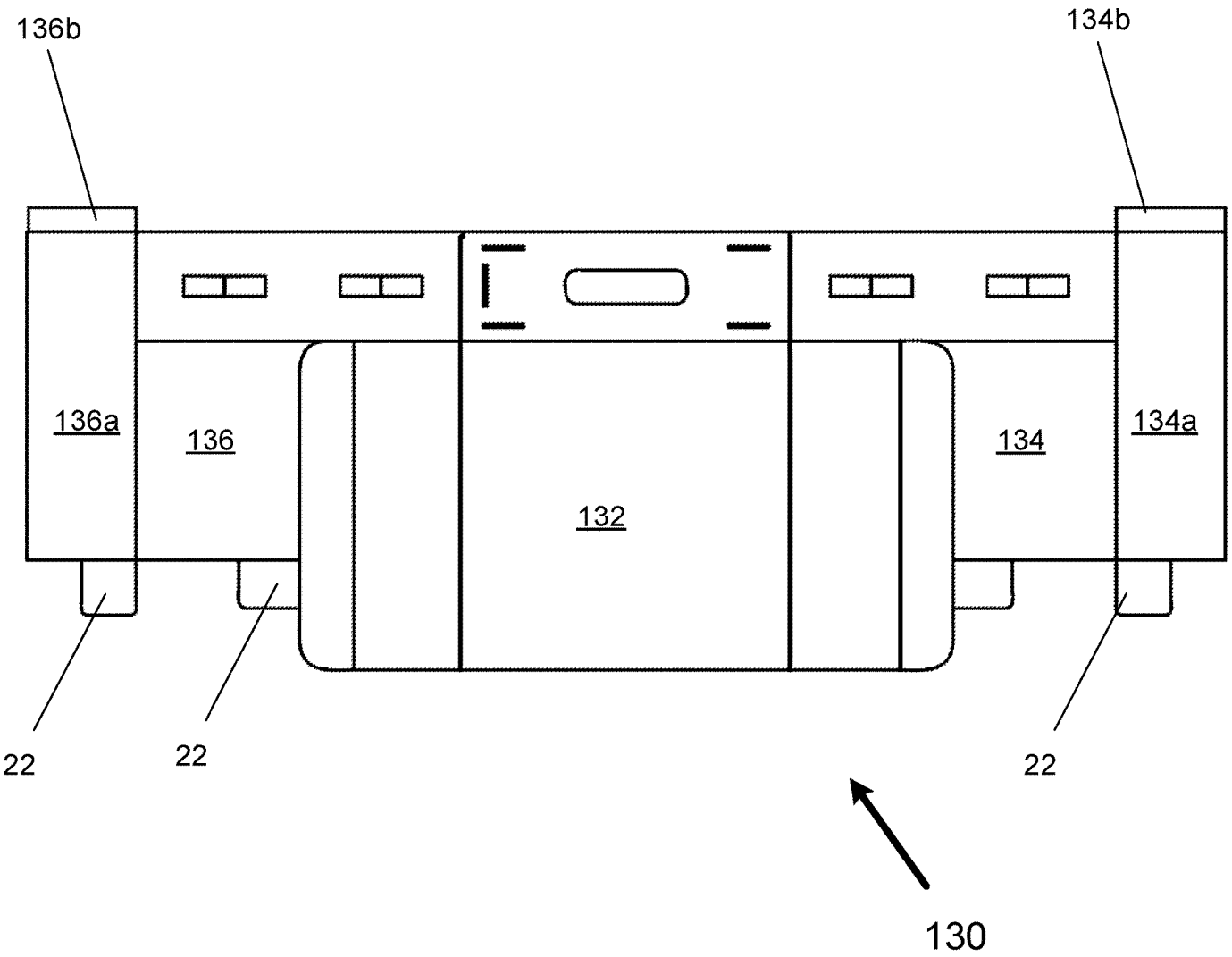
FIG. 24 shows a back view of the base unit of FIG. 19 in a flattened configuration.
Figure 28:
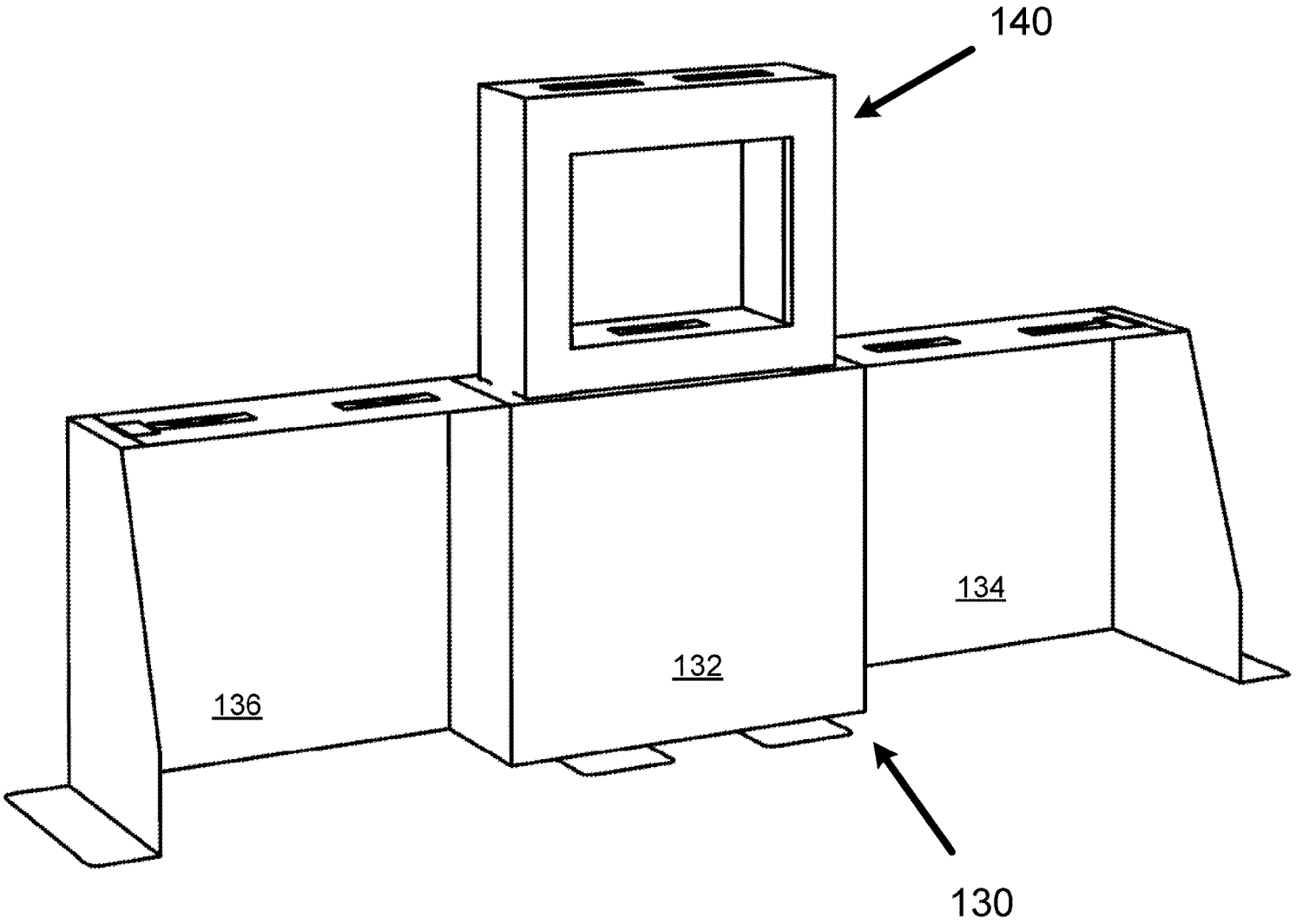
FIG. 28 is a back perspective view of the assembled target of FIG. 25.

The right and left base units also each have a side 134*a*, 136*a*, which foldingly connect along an edge to the front of each unit. The sides each may be angled or beveled or angled along the back edge, as seen in FIG. 28. Securing flaps 134*b*, 136*b* at the top are used to help secure the sides when the full base is assembled. As described above, all components can be fully unfolded into a flattened configuration, as seen in FIGS. 23 and 24.

Figure 25:
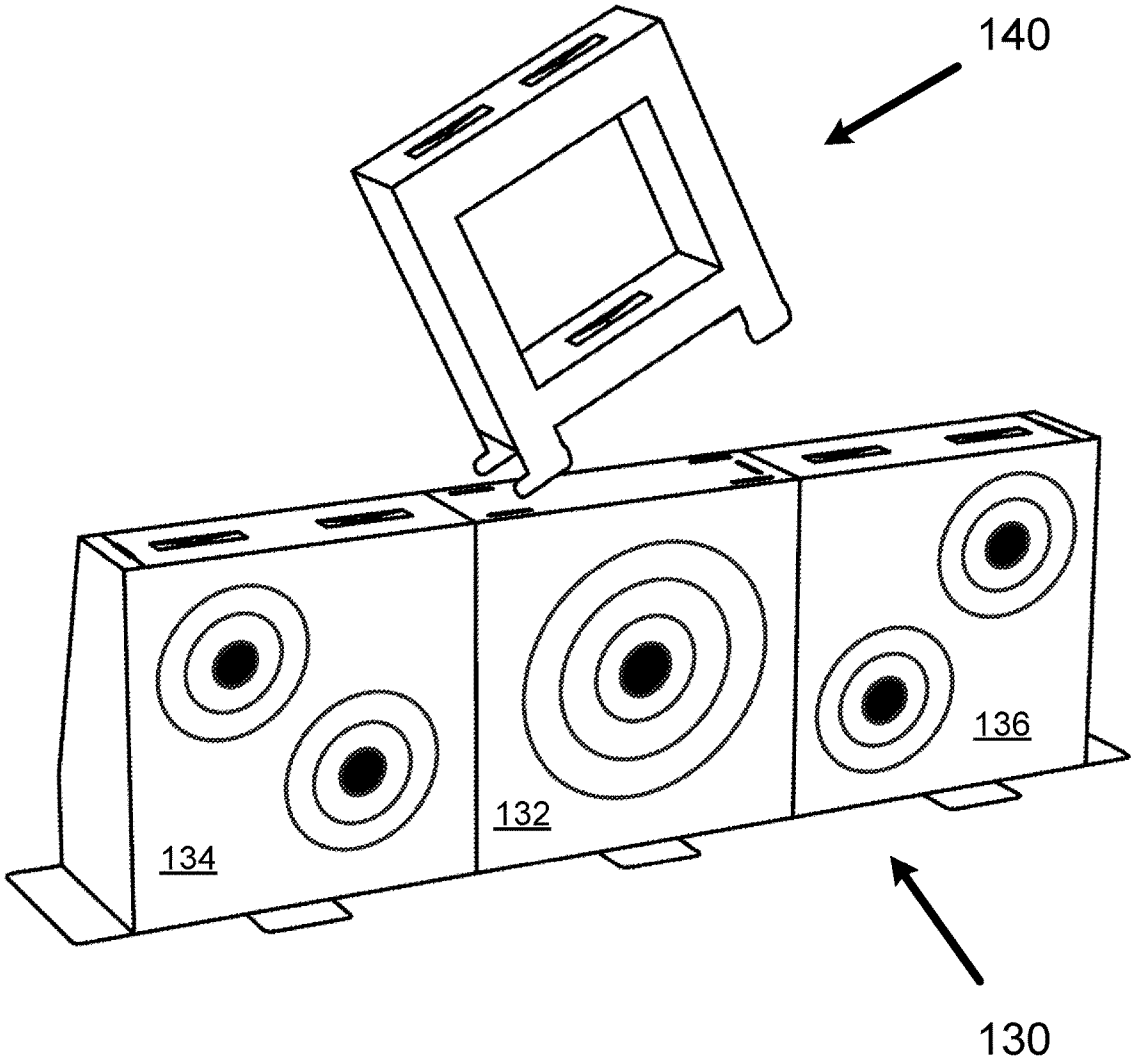
FIG. 25 shows a front perspective view of the shelf unit of FIG. 14 being assembled with the base unit of FIG. 19.
Figure 26:
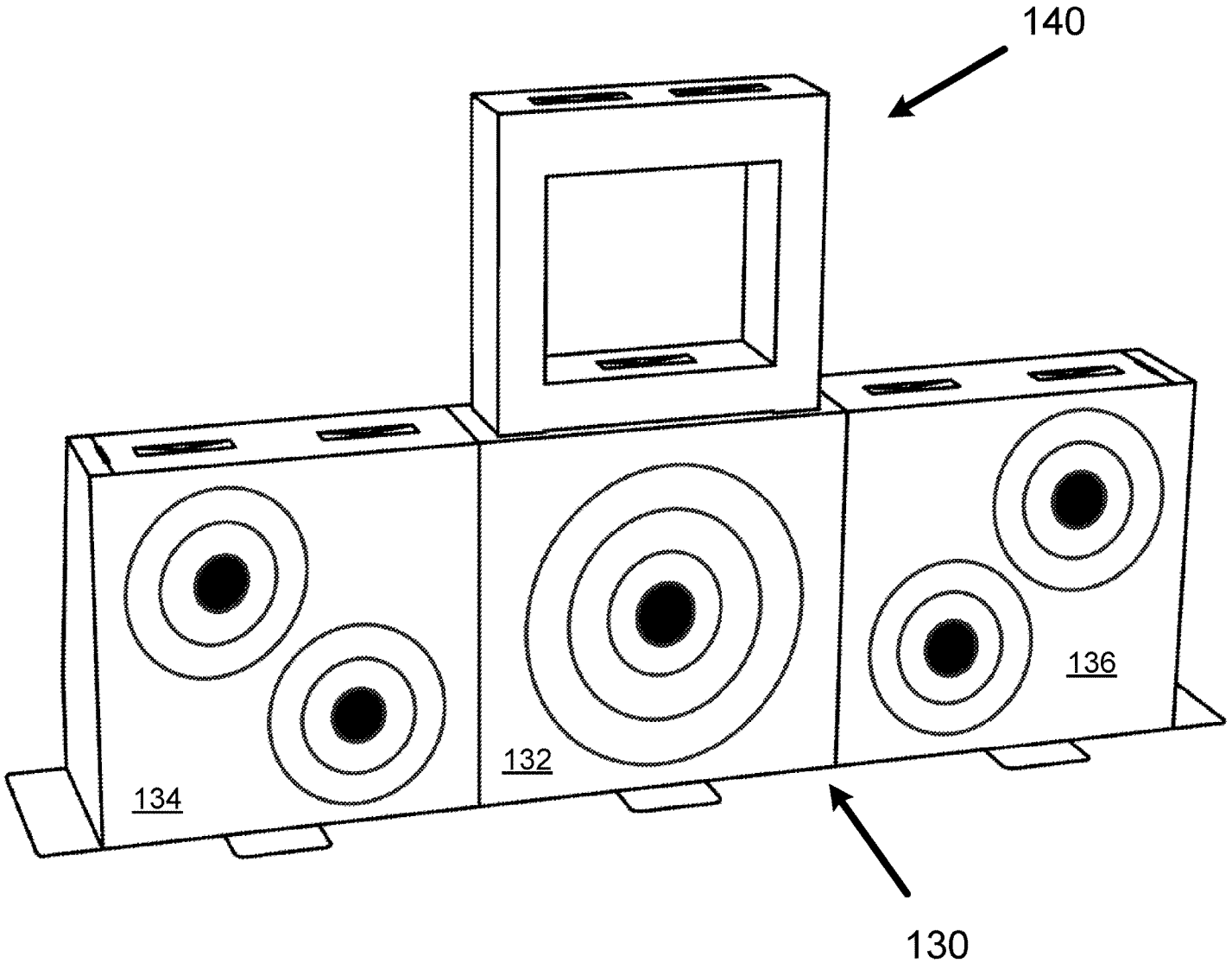
FIG. 26 is a front perspective view of the assembled target of FIG. 25.
Figure 27:
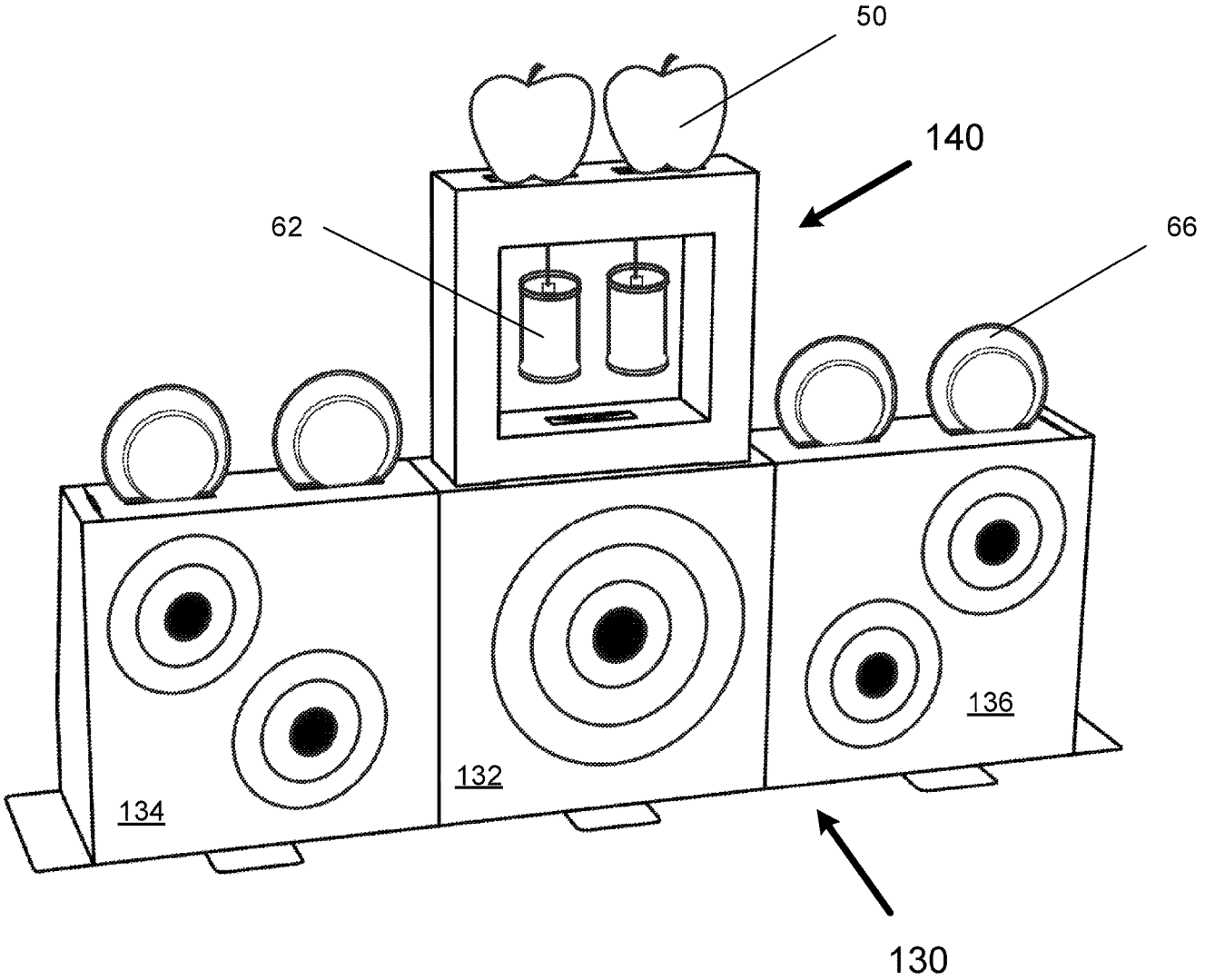
FIG. 27 is a front perspective view of the assembled target of FIG. 26 with targeting options added.

While the base unit and shelf unit can be used separately, the full target is constructed by connecting the assembled shelf unit to the top of the central base unit, as seen in FIGS. 25 and 26. As discussed above, first the long tabs of the shelf unit are inserted into corresponding slots in the top of the central base unit, and then the shorter tabs of the shelf units are inserted into their corresponding slots. The fully assembled target, with apples 50, dishes 66, and suspended cans 62 put in place is shown in FIG. 27.

Figure 29:
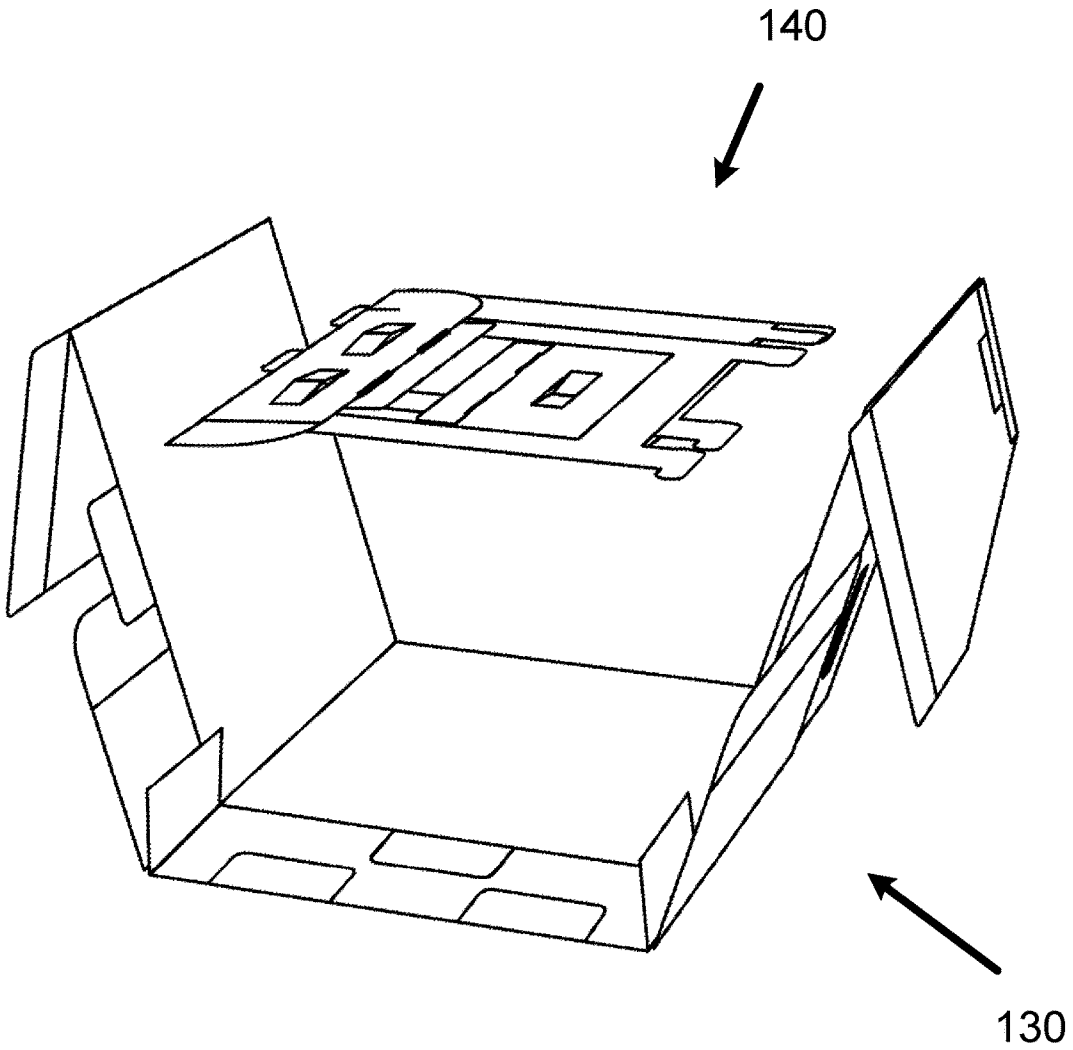
FIG. 29 is a perspective view of the shelf unit and base unit being folded together.
Figure 30:
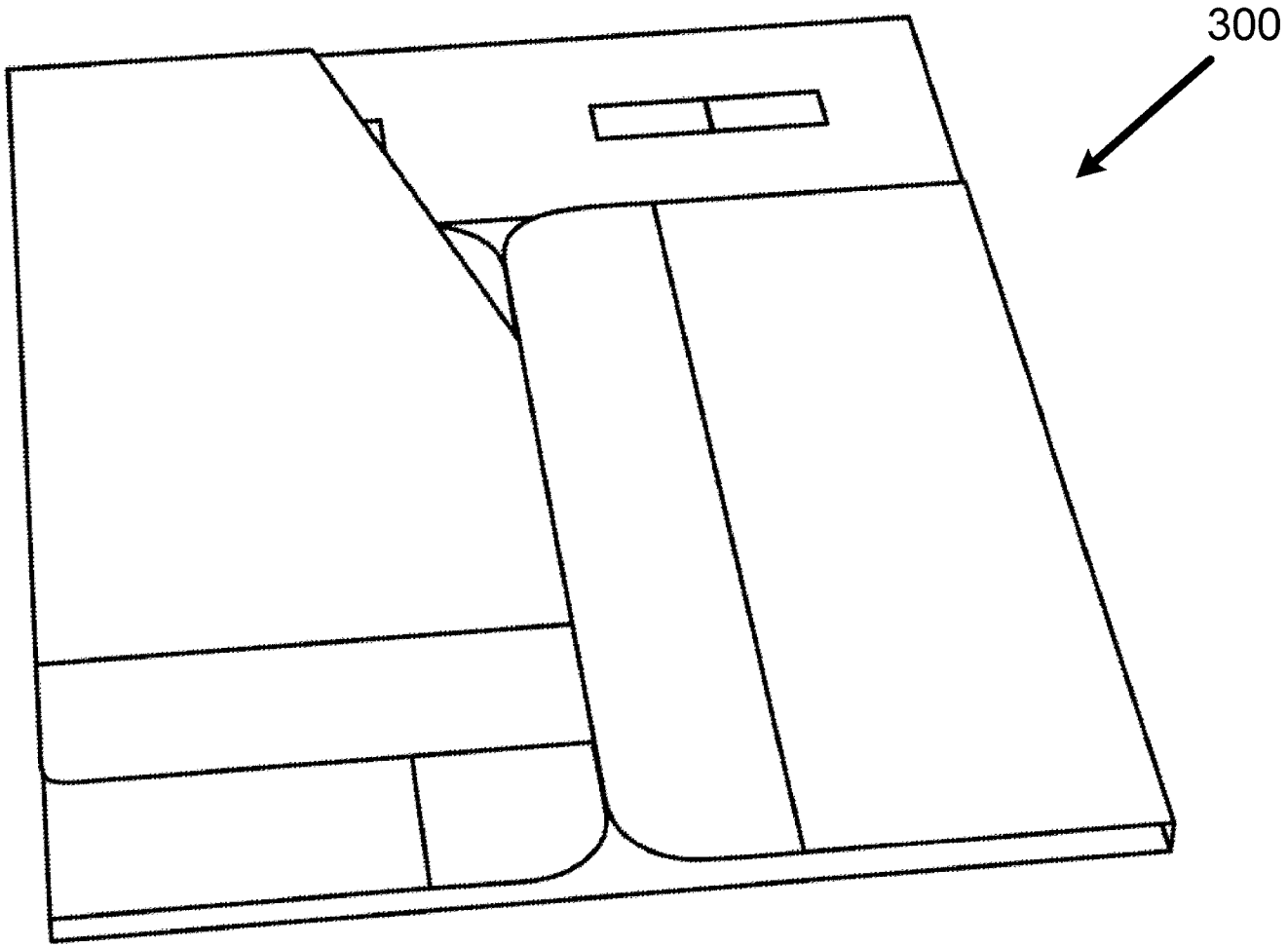
FIG. 30 is a front perspective view of the folded target.
Figure 31:
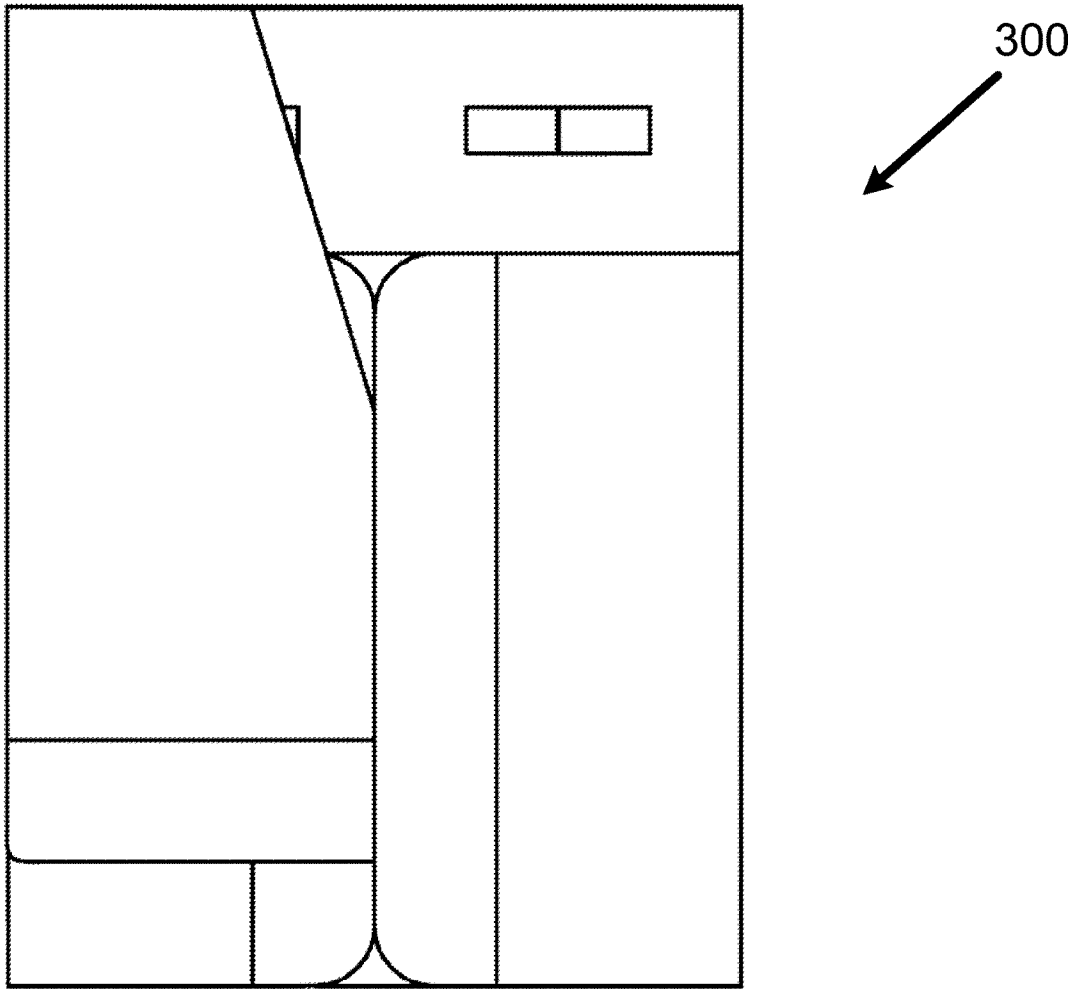
FIG. 31 is another front view of the folded target of FIG. 30.
Figure 32:
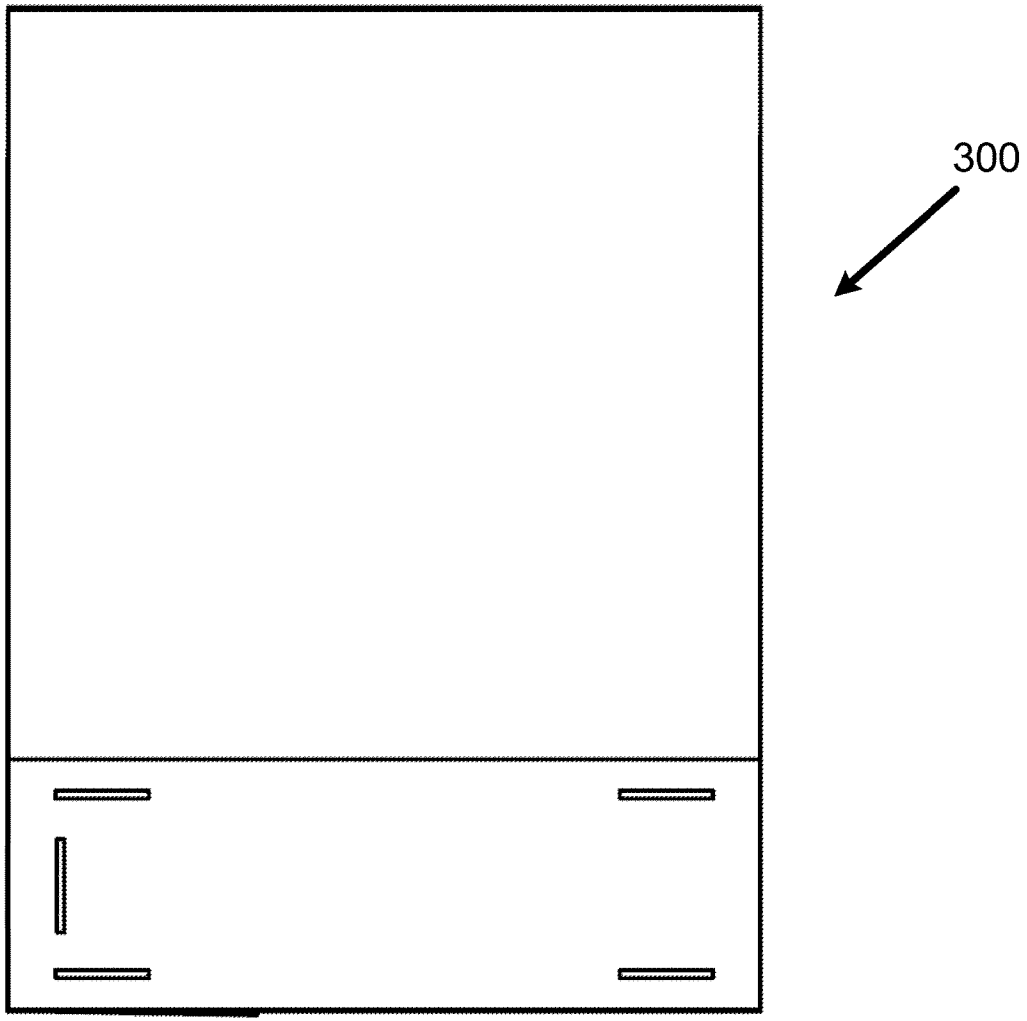
FIG. 32 is a back view of the folded target of FIG. 30.

For packaging, sales, and transport, the shelf unit can be folded inside the base unit, as seen in FIG. 29. The folded shelf unit, in flattened configuration 140, is placed upon the folded central base unit, also in flattened configuration. The right and left base units are folded along respective edges over the folded shelf unit, to form a secure folded package 300, as seen in FIGS. 30-32. The beveled edges of the sides, described above, may be tucked under opposing components to help secure the package and prevent unwanted unfolding. The package may be shrink-wrapped for marketing, as described above.

Figure 33:
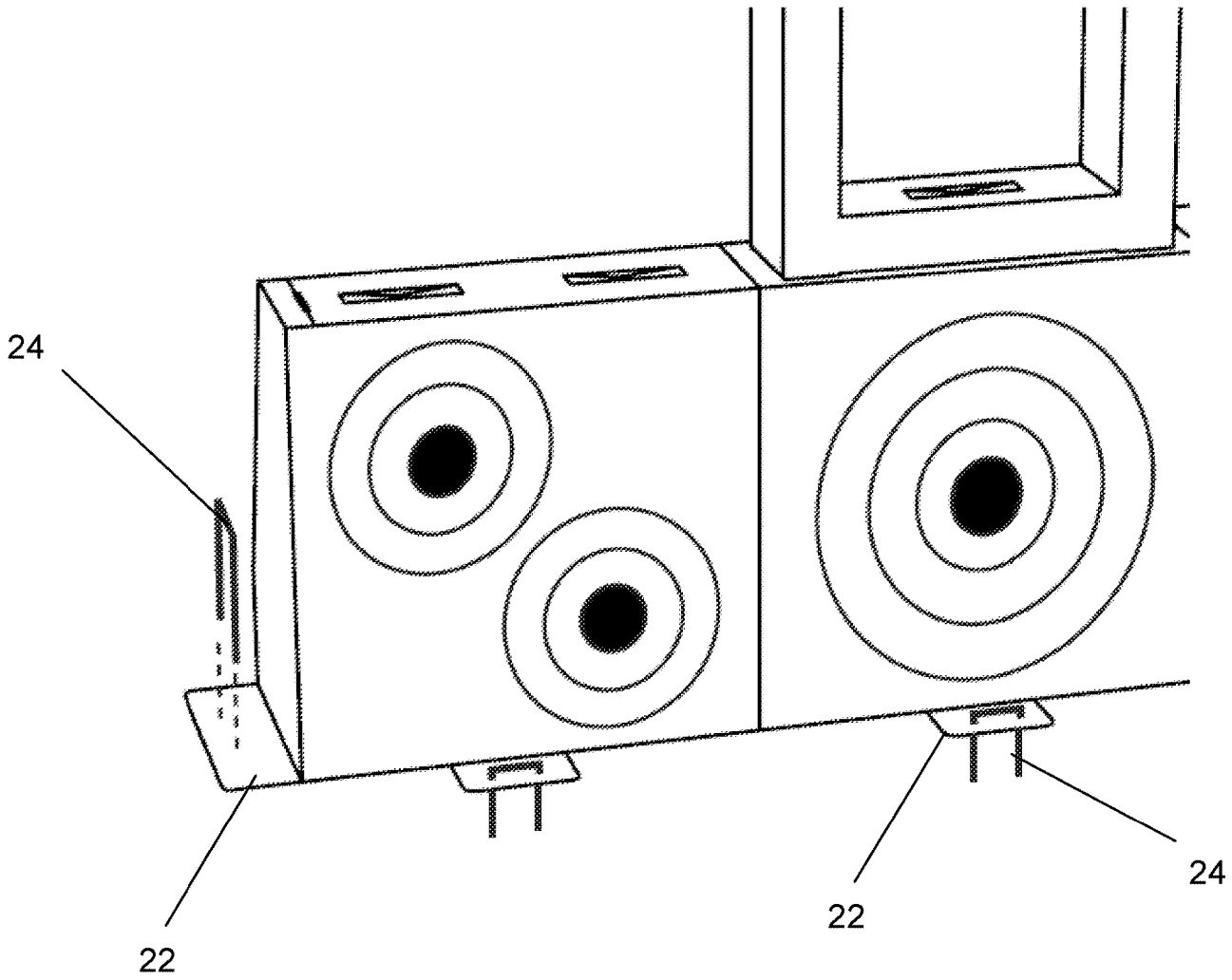
FIG. 33 is a close-up view of stakes being used to secured the assembled target.

A plurality of stake tabs 22 extend from the front, back and sides of the components of the base unit, as seen in FIGS. 19-22. These are used with stakes 24, as described above, to help secure the assembled target to the ground, as seen in FIG. 33.

By offering a variety of components for target shooting, the user is able to shoot multiple rounds of ammunition at the target apparatus without pausing for target resetting or reloading. Depending on the material used for construction of the apparatus, a variety of firearms may be used. For example, where paper or cardboard or similar material is used, recommended firearms include rifles, handguns, BB-guns, and pellet guns. Depending on the material used for construction, and the amount of use, the apparatus may be single-use or multiple-use.

After use, the product can moved in an assembled form, or may be collapsed, in whole or in part, for re-use, or it may be disposed of. In one embodiment, the side panels or wings can be folded inward to the front face, and secured thereto by the custom cutouts on the bottom of the box (by insertion of the stake tabs on the side panels in the cutouts), thereby allow the product to be moved in a convenient fashion while substantially assembled. Accordingly, the apparatus provides a simple, flexible, portable, easy-to-assemble target shooting system for recreational shooting and training.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A shooting target apparatus for firearms, comprising:

a multi-part collapsible target support for shooting of firearms, configured to both be a shooting target itself and a support for additional three-dimensional targets, said multi-part collapsible target support comprising a three-part base unit and a shelf unit, wherein the three-part base unit has with both an unfolded configuration and a folded configuration, and the shelf unit has both an unfolded configuration and a folded configuration;

said three-part base unit comprising a six-sided central base support with a top side, a bottom side, a front side, a back side, a right side, and a left side, wherein the top side is hingedly attached to the front side along a mutual first edge, the top side is hingedly attached to the back side along a mutual second edge, the bottom side is hingedly attached to the front side along a mutual third edge, the bottom side is hingedly attached to the back side along a mutual fourth edge;

wherein the right side comprises a right side securing flap extending along a front edge of the right side, and is hingedly attached only to the back side along a back edge opposite the securing flap; and wherein the left side comprises a left side securing flap extending along a front edge of the left side, and is hingedly attached only to the back side along a back edge opposite the securing flap;

a three-sided right base support with a top side, a front side, and a right side, wherein the right side of the right base support has a top edge, a front edge, a back edge, and a bottom edge with a right base support side stake tab foldingly attached thereto, wherein the back edge is angled outward from the top edge to the bottom edge at least in part so the bottom edge is longer than the top edge; and a three-sided left base support with a top side, a front side, and a left side, wherein the left side of the left base support has a top edge, a front edge, a back edge, and a bottom edge with a left base support side stake tab foldingly attached thereto, wherein the back edge is angled outward from the top edge to the bottom edge at least in part so the bottom edge is longer than the top edge;

a first plurality of slots in the top side of the central base support, a second plurality of slots in the top side of the right base support, and a third plurality of slots in the top side of the left base support, wherein at least some of the plurality of slots in the top side of the central base support are parallel to a plane formed by the front side of the central base support, and at least some of the slots in the top side of the central base support are perpendicular to the plane formed by the front side of the central base support;

wherein the front side of the right base support is foldingly attached to the front side of the central base support along a fifth mutual edge between the front side of the right base support and the front side of the central base support;

wherein the front side of the left base support is foldingly attached to the front side of the central base support along a sixth mutual edge opposite the fifth mutual edge; and further comprising a plurality of shooting targets displayed on the front side of the central base support, the front side of the right base support, and the front side of the left base support; and said shelf unit comprising a box with a top side, a front side, a back side, a right side, and a left side, with a rectilinear hole centrally disposed in each of the front side and the back side with a bottom shelf extending therebetween;

a first pair of tabs extending downward from the front side and back side of the shelf unit proximate the right side or left side of the shelf unit;

a second pair of tabs extending downward from the front side and back side of the shelf unit proximate the left side or right side opposite the first pair of tabs, wherein the second pair of tabs each comprise an elongated end forming an L-shape to securely engage a corresponding slot of said plurality of slots in the top side of the central base support;

a plurality of slots in the top side of the shelf unit, said plurality of slots configured to hold said additional three-dimensional targets in a target position for firearms shooting; and a plurality of slots in the bottom shelf configured to hold said additional three-dimensional targets in a target position.

2. The shooting target apparatus of claim 1, wherein the front sides of the central base support, right base support, and left base support each have a bottom edge, and further comprising a plurality of stake tabs extending outward from the bottom edge of the front side of the central base support, the bottom edge of the front side of the right base support, and the bottom edge of the front side of the left base support, said tabs configured to secure the base unit to the ground when unfolded.

3. The shooting target apparatus of claim 1, further comprising a plurality of suspension hooks or holes in the front side or the back side of the shelf unit.

4. The shooting target apparatus of claim 1, wherein in said folded configuration, the shelf unit is folded substantially flat and is contained within the folded three-part base unit.

5. The shooting target apparatus of claim 1, wherein the multi-part collapsible target support is configured to be disposed of after a single use as a firearm shooting target with multiple rounds of ammunition.

6. A method of shooting targets with a firearm, comprising the steps of:

providing a shooting target apparatus as set forth in claim 1;

transporting the shooting target apparatus, with said three-part base unit and said shelf unit in folded configuration, to a target shooting location;

unfolding the three-part base unit and the shelf unit and assembling the shooting target apparatus therefrom at the target shooting location; and shooting a firearm at the shooting target apparatus.

7. The method of claim 6, further comprising the step of placing additional targets on the three-part base unit and/or the shelf unit.

8. The method of claim 6, wherein the step of shooting a firearm comprises shooting multiple rounds of ammunition at the shooting target apparatus without pausing for target resetting.

9. The method of claim 6, further comprising the step of disposing of the shooting target apparatus after the step of shooting a firearm.

* * * * *